US010097939B2

(12) United States Patent
Sheen et al.

(10) Patent No.: US 10,097,939 B2
(45) Date of Patent: Oct. 9, 2018

(54) COMPENSATION FOR SPEAKER NONLINEARITIES

(71) Applicant: Sonos, Inc., Santa Barbara, CA (US)

(72) Inventors: Timothy W. Sheen, Brighton, MA (US); Simon Jarvis, Cambridge, MA (US); Romi Kadri, Boston, MA (US); Yean-Nian Willy Chen, Santa Barbara, CA (US)

(73) Assignee: SONOS, INC., Santa Barbara, CA (US)

( * ) Notice: Subject to any disclaimer, the term of this patent is extended or adjusted under 35 U.S.C. 154(b) by 0 days.

(21) Appl. No.: 15/438,741

(22) Filed: Feb. 21, 2017

(65) Prior Publication Data

US 2017/0245079 A1 Aug. 24, 2017

Related U.S. Application Data

(60) Provisional application No. 62/298,433, filed on Feb. 22, 2016.

(51) Int. Cl.
*H04R 29/00* (2006.01)
*H04R 3/04* (2006.01)

(52) U.S. Cl.
CPC ..... *H04R 29/007* (2013.01); *H04R 3/04* (2013.01); *H04R 2227/003* (2013.01); *H04R 2227/005* (2013.01); *H04R 2227/007* (2013.01)

(58) Field of Classification Search
CPC .. H04R 29/007; H04R 3/04; H04R 2227/003; H04R 2227/005; H04R 2227/007
See application file for complete search history.

(56) References Cited

U.S. PATENT DOCUMENTS

| | | | |
|---|---|---|---|
| 4,941,187 | A | 7/1990 | Slater |
| 5,440,644 | A | 8/1995 | Farinelli et al. |
| 5,740,260 | A | 4/1998 | Odom |
| 5,761,320 | A | 6/1998 | Farinelli et al. |
| 5,923,902 | A | 7/1999 | Inagaki |
| 6,032,202 | A | 2/2000 | Lea et al. |
| 6,256,554 | B1 | 7/2001 | Dilorenzo |
| 6,301,603 | B1 | 10/2001 | Maher et al. |
| 6,311,157 | B1 | 10/2001 | Strong |
| 6,404,811 | B1 | 6/2002 | Cvetko et al. |

(Continued)

FOREIGN PATENT DOCUMENTS

| | | | |
|---|---|---|---|
| AU | 2017100486 | A4 | 6/2017 |
| AU | 2017100581 | A4 | 6/2017 |

(Continued)

OTHER PUBLICATIONS

US 9,299,346, 03/2016, Hart et al. (withdrawn)

(Continued)

*Primary Examiner* — Sonia Gay

(57) ABSTRACT

A first signal may be received indicative of audio to be played by a speaker. A second signal may be received which comprises (i) a voice input received by a microphone and (ii) at least a portion of the audio played by the speaker at a same time that the microphone receives the voice input. Based on the first signal, nonlinearities output by the speaker which played the audio may be determined. At least the nonlinearities from the second signal may be removed to output a third signal comprising substantially the voice input received at the microphone.

16 Claims, 14 Drawing Sheets

(56) References Cited

U.S. PATENT DOCUMENTS 6,469,633 B1 10/2002 Wachter
6,522,886 B1 2/2003 Youngs et al.
6,594,347 B1 * 7/2003 Calder ..... H04M 3/493 379/88.01
6,611,537 B1 8/2003 Edens et al.
6,631,410 B1 10/2003 Kowalski et al.
6,757,517 B2 6/2004 Chang
6,778,869 B2 8/2004 Champion
7,130,608 B2 10/2006 Hollstrom et al.
7,130,616 B2 10/2006 Janik
7,143,939 B2 12/2006 Henzerling
7,236,773 B2 6/2007 Thomas
7,295,548 B2 11/2007 Blank et al.
7,391,791 B2 6/2008 Balassanian et al.
7,483,538 B2 1/2009 McCarty et al.
7,571,014 B1 8/2009 Lambourne et al.
7,630,501 B2 12/2009 Blank et al.
7,643,894 B2 1/2010 Braithwaite et al.
7,657,910 B1 2/2010 McAulay et al.
7,661,107 B1 2/2010 Van Dyke et al.
7,702,508 B2 4/2010 Bennett
7,853,341 B2 12/2010 McCarty et al.
7,987,294 B2 7/2011 Bryce et al.
8,014,423 B2 9/2011 Thaler et al.
8,041,565 B1 10/2011 Bhardwaj et al.
8,045,952 B2 10/2011 Qureshey et al.
8,073,125 B2 12/2011 Zhang et al.
8,103,009 B2 1/2012 McCarty et al.
8,234,395 B2 7/2012 Millington et al.
8,239,206 B1 8/2012 Lebeau et al.
8,255,224 B2 8/2012 Singleton et al.
8,290,603 B1 10/2012 Lambourne
8,364,481 B2 1/2013 Strope et al.
8,386,261 B2 2/2013 Mellott et al.
8,423,893 B2 4/2013 Ramsay et al.
8,428,758 B2 4/2013 Naik et al.
8,453,058 B1 5/2013 Coccaro et al.
8,483,853 B1 7/2013 Lambourne
8,484,025 B1 7/2013 Moreno et al.
8,831,761 B2 9/2014 Kemp et al.
8,831,957 B2 9/2014 Taubman et al.
8,938,394 B1 1/2015 Faaborg et al.
8,942,252 B2 1/2015 Balassanian et al.
8,983,844 B1 3/2015 Thomas et al.
9,042,556 B2 5/2015 Kallai et al.
9,094,539 B1 7/2015 Noble
9,215,545 B2 12/2015 Dublin et al.
9,251,793 B2 2/2016 Lebeau et al.
9,262,612 B2 2/2016 Cheyer
9,288,597 B2 3/2016 Carlsson et al.
9,300,266 B2 3/2016 Grokop
9,318,107 B1 4/2016 Sharifi
9,319,816 B1 4/2016 Narayanan
9,412,392 B2 8/2016 Lindahl et al.
9,426,567 B2 8/2016 Lee et al.
9,431,021 B1 8/2016 Scalise et al.
9,443,527 B1 9/2016 Watanabe et al.
9,472,201 B1 10/2016 Sleator
9,472,203 B1 10/2016 Ayrapetian et al.
9,484,030 B1 11/2016 Meaney et al.
9,489,948 B1 11/2016 Chu et al.
9,494,683 B1 11/2016 Sadek
9,509,269 B1 11/2016 Rosenberg
9,514,752 B2 12/2016 Sharifi
9,536,541 B2 1/2017 Chen et al.
9,548,066 B2 1/2017 Jain et al.
9,552,816 B2 1/2017 Vanlund et al.
9,560,441 B1 1/2017 McDonough, Jr. et al.
9,601,116 B2 3/2017 Melendo Casado et al.
9,615,170 B2 4/2017 Kirsch et al.
9,615,171 B1 4/2017 O'Neill et al.
9,632,748 B2 4/2017 Faaborg et al.
9,633,186 B2 4/2017 Ingrassia, Jr. et al.
9,633,368 B2 4/2017 Greenzeiger et al.
9,633,660 B2 4/2017 Haughay et al.
9,633,671 B2 4/2017 Giacobello et al.
9,633,674 B2 4/2017 Sinha et al.
9,640,179 B1 5/2017 Hart et al.
9,640,183 B2 5/2017 Jung et al.
9,641,919 B1 5/2017 Poole et al.
9,646,614 B2 5/2017 Bellegarda et al.
9,653,060 B1 5/2017 Hilmes et al.
9,653,075 B1 5/2017 Chen et al.
9,659,555 B1 5/2017 Hilmes et al.
9,672,821 B2 6/2017 Krishnaswamy et al.
9,685,171 B1 6/2017 Yang
9,691,378 B1 6/2017 Meyers et al.
9,691,379 B1 6/2017 Mathias et al.
9,697,826 B2 7/2017 Sainath et al.
9,697,828 B1 7/2017 Prasad et al.
9,698,999 B2 7/2017 Mutagi et al.
9,704,478 B1 7/2017 Vitaladevuni et al.
9,721,568 B1 8/2017 Polansky et al.
9,721,570 B1 8/2017 Beal et al.
9,728,188 B1 8/2017 Rosen et al.
9,734,822 B1 8/2017 Sundaram et al.
9,747,011 B2 8/2017 Lewis et al.
9,747,899 B2 8/2017 Pogue et al.
9,747,920 B2 8/2017 Ayrapetian et al.
9,747,926 B2 8/2017 Sharifi et al.
9,754,605 B1 9/2017 Chhetri
9,826,306 B2 11/2017 Lang
2001/0042107 A1 11/2001 Palm
2002/0022453 A1 2/2002 Balog et al.
2002/0026442 A1 2/2002 Lipscomb et al.
2002/0034280 A1 3/2002 Infosino
2002/0072816 A1 6/2002 Shdema et al.
2002/0124097 A1 9/2002 Isely et al.
2003/0157951 A1 8/2003 Hasty
2004/0024478 A1 2/2004 Hans et al.
2005/0195988 A1 9/2005 Tashev et al.
2005/0283330 A1 12/2005 Laraia et al.
2006/0147058 A1 7/2006 Wang
2006/0190968 A1 8/2006 Jung et al.
2006/0247913 A1 11/2006 Huerta et al.
2007/0018844 A1 1/2007 Sutardja
2007/0019815 A1 1/2007 Asada et al.
2007/0033043 A1 2/2007 Hyakumoto
2007/0076131 A1 4/2007 Li et al.
2007/0140058 A1 6/2007 McIntosh et al.
2007/0142944 A1 6/2007 Goldberg et al.
2008/0090537 A1 4/2008 Sutardja
2008/0248797 A1 10/2008 Freeman et al.
2009/0003620 A1 1/2009 McKillop et al.
2009/0005893 A1 1/2009 Sugii et al.
2009/0018828 A1 1/2009 Nakadai et al.
2009/0076821 A1 3/2009 Brenner et al.
2009/0197524 A1 8/2009 Haff et al.
2009/0228919 A1 9/2009 Zott et al.
2009/0238377 A1 9/2009 Ramakrishnan et al.
2009/0326949 A1 12/2009 Douthitt et al.
2010/0014690 A1 1/2010 Wolff et al.
2010/0023638 A1 1/2010 Bowman
2010/0075723 A1 3/2010 Min et al.
2010/0179874 A1 7/2010 Higgins et al.
2010/0211199 A1 8/2010 Naik et al.
2011/0033059 A1 * 2/2011 Bhaskar ..... H04M 9/082 381/71.4
2011/0091055 A1 4/2011 Leblanc
2011/0145581 A1 6/2011 Malhotra et al.
2011/0267985 A1 11/2011 Wilkinson et al.
2011/0280422 A1 11/2011 Neumeyer et al.
2011/0299706 A1 12/2011 Sakai
2012/0131125 A1 5/2012 Seidel et al.
2012/0163603 A1 6/2012 Abe et al.
2012/0177215 A1 7/2012 Bose et al.
2012/0297284 A1 11/2012 Matthews, III et al.
2013/0006453 A1 1/2013 Wang et al.
2013/0024018 A1 1/2013 Chang et al.
2013/0058492 A1 3/2013 Silzle et al.
2013/0066453 A1 3/2013 Seefeldt
2013/0148821 A1 6/2013 Sorensen
2013/0179173 A1 7/2013 Lee et al.
2013/0183944 A1 7/2013 Mozer et al.

(56) References Cited

U.S. PATENT DOCUMENTS

2013/0191122 A1 7/2013 Mason
2013/0216056 A1* 8/2013 Thyssen ..... H04M 9/082 381/66
2013/0317635 A1 11/2013 Bates et al.
2013/0329896 A1 12/2013 Krishnaswamy et al.
2013/0331970 A1 12/2013 Beckhardt et al.
2013/0343567 A1 12/2013 Triplett et al.
2014/0003611 A1 1/2014 Mohammad et al.
2014/0003635 A1 1/2014 Mohammad et al.
2014/0006026 A1 1/2014 Lamb et al.
2014/0064501 A1 3/2014 Olsen et al.
2014/0075306 A1 3/2014 Rega
2014/0094151 A1 4/2014 Klappert et al.
2014/0100854 A1 4/2014 Chen et al.
2014/0167931 A1 6/2014 Lee et al.
2014/0195252 A1 7/2014 Gruber et al.
2014/0244013 A1 8/2014 Reilly
2014/0258292 A1 9/2014 Thramann et al.
2014/0270282 A1 9/2014 Tammi et al.
2014/0274185 A1 9/2014 Luna et al.
2014/0363022 A1 12/2014 Dizon et al.
2015/0010169 A1 1/2015 Popova et al.
2015/0016642 A1 1/2015 Walsh et al.
2015/0086034 A1 3/2015 Lombardi et al.
2015/0104037 A1 4/2015 Lee et al.
2015/0154976 A1 6/2015 Mutagi
2015/0180432 A1 6/2015 Gao et al.
2015/0189438 A1 7/2015 Hampiholi et al.
2015/0200454 A1 7/2015 Heusdens et al.
2015/0222987 A1 8/2015 Angel, Jr. et al.
2015/0228274 A1 8/2015 Leppänen et al.
2015/0253292 A1 9/2015 Larkin et al.
2015/0253960 A1 9/2015 Lin et al.
2015/0271593 A1 9/2015 Sun et al.
2015/0280676 A1 10/2015 Holman et al.
2015/0296299 A1 10/2015 Klippel et al.
2015/0302856 A1 10/2015 Kim et al.
2015/0341406 A1 11/2015 Rockefeller et al.
2015/0363061 A1 12/2015 De Nigris, III et al.
2015/0363401 A1 12/2015 Chen et al.
2015/0371657 A1 12/2015 Gao et al.
2015/0380010 A1 12/2015 Srinivasan
2016/0007116 A1 1/2016 Holman
2016/0021458 A1 1/2016 Johnson et al.
2016/0029142 A1 1/2016 Isaac et al.
2016/0036962 A1 2/2016 Rand et al.
2016/0042748 A1 2/2016 Jain et al.
2016/0057522 A1 2/2016 Choisel et al.
2016/0077710 A1 3/2016 Lewis et al.
2016/0093304 A1 3/2016 Kim et al.
2016/0098393 A1 4/2016 Hebert
2016/0157035 A1 6/2016 Russell et al.
2016/0173578 A1 6/2016 Sharma et al.
2016/0212538 A1 7/2016 Fullam et al.
2016/0225385 A1* 8/2016 Hammarqvist ..... G10L 21/0208
2016/0232451 A1 8/2016 Scherzer
2016/0234204 A1 8/2016 Rishi et al.
2016/0239255 A1 8/2016 Chavez et al.
2016/0260431 A1 9/2016 Newendorp et al.
2016/0314782 A1 10/2016 Klimanis
2016/0352915 A1* 12/2016 Gautama ..... H04M 9/082
2016/0353218 A1 12/2016 Starobin et al.
2017/0003931 A1 1/2017 Dvortsov et al.
2017/0026769 A1 1/2017 Patel
2017/0060526 A1 3/2017 Barton et al.
2017/0070478 A1 3/2017 Park et al.
2017/0076720 A1 3/2017 Gopalan et al.
2017/0078824 A1 3/2017 Heo
2017/0084292 A1 3/2017 Yoo
2017/0090864 A1 3/2017 Jorgovanovic
2017/0092278 A1 3/2017 Evermann et al.
2017/0092297 A1 3/2017 Sainath et al.
2017/0103755 A1 4/2017 Jeon et al.
2017/0125037 A1 5/2017 Shin
2017/0177585 A1 6/2017 Rodger et al.
2017/0178662 A1 6/2017 Ayrapetian et al.
2017/0193999 A1 7/2017 Aleksic et al.
2017/0206896 A1 7/2017 Ko et al.
2017/0236512 A1 8/2017 Williams et al.
2017/0242653 A1 8/2017 Lang et al.
2017/0270919 A1 9/2017 Parthasarathi et al.

FOREIGN PATENT DOCUMENTS

EP 1349146 A1 10/2003
EP 1389853 A1 2/2004
EP 2351021 B1 9/2017
JP 2001236093 A 8/2001
JP 2004347943 A 12/2004
JP 2004354721 A 12/2004
JP 2005284492 A 10/2005
JP 2008079256 A 4/2008
JP 2008158868 A 7/2008
JP 2010141748 A 6/2010
JP 2013037148 A 2/2013
JP 2014071138 A 4/2014
JP 2014137590 A 7/2014
KR 20100111071 A 10/2010
WO 200153994 7/2001
WO 2003093950 A2 11/2003
WO 2015037396 A1 3/2015
WO 2015178950 A1 11/2015
WO 2016033364 A1 3/2016
WO 2017039632 A1 3/2017

OTHER PUBLICATIONS

Yamaha DME 64 Owner's Manual; copyright 2004, 80 pages.
Yamaha DME Designer 3.5 setup manual guide; copyright 2004, 16 pages.
Yamaha DME Designer 3.5 User Manual; Copyright 2004, 507 pages.
AudioTron Quick Start Guide, Version 1.0, Mar. 2001, 24 pages.
AudioTron Reference Manual, Version 3.0, May 2002, 70 pages.
AudioTron Setup Guide, Version 3.0, May 2002, 38 pages.
Bluetooth. "Specification of the Bluetooth System: The ad hoc SCATTERNET for affordable and highly functional wireless connectivity," Core, Version 1.0 A, Jul. 26, 1999, 1068 pages.
Bluetooth. "Specification of the Bluetooth System: Wireless connections made easy," Core, Version 1.0 B, Dec. 1, 1999, 1076 pages.
Corrected Notice of Allowability dated Mar. 8, 2017, issued in connection with U.S. Appl. No. 15/229,855, filed Aug. 5, 2016, 6 pages.
Dell, Inc. "Dell Digital Audio Receiver: Reference Guide," Jun. 2000, 70 pages.
Dell, Inc. "Start Here," Jun. 2000, 2 pages.
"Denon 2003-2004 Product Catalog," Denon, 2003-2004, 44 pages.
Final Office Action dated Aug. 11, 2017, issued in connection with U.S. Appl. No. 15/131,776, filed Apr. 18, 2016, 7 pages.
Final Office Action dated Jun. 15, 2017, issued in connection with U.S. Appl. No. 15/098,718, filed Apr. 14, 2016, 15 pages.
International Searching Authority, International Search Report and Written Opinion dated May 23, 2017, issued in connection with International Application No. PCT/US2017/018739, Filed Feb. 21, 2017, 10 pages.
International Searching Authority, International Search Report and Written Opinion dated May 30, 2017, issued in connection with International Application No. PCT/US2017/018728, Filed Feb. 21, 2017, 11 pages.
Jo et al., "Synchronized One-to-many Media Streaming with Adaptive Playout Control," Proceedings of SPIE, 2002, pp. 71-82, vol. 4861.
Jones, Stephen, "Dell Digital Audio Receiver: Digital upgrade for your analog stereo," Analog Stereo, Jun. 24, 2000 retrieved Jun. 18, 2014, 2 pages.
Louderback, Jim, "Affordable Audio Receiver Furnishes Homes With MP3," TechTV Vault. Jun. 28, 2000 retrieved Jul. 10, 2014, 2 pages.

(56) References Cited

OTHER PUBLICATIONS

Non-Final Office Action dated Jun. 1, 2017, issued in connection with U.S. Appl. No. 15/223,218, filed Jul. 29, 2016, 7 pages.
Non-Final Office Action dated Feb. 7, 2017, issued in connection with U.S. Appl. No. 15/131,244, filed Apr. 18, 2016, 12 pages.
Non-Final Office Action dated Feb. 8, 2017, issued in connection with U.S. Appl. No. 15/098,892, filed Apr. 14, 2016, 17 pages.
Non-Final Office Action dated Mar. 9, 2017, issued in connection with U.S. Appl. No. 15/098,760, filed Apr. 14, 2016, 13 pages.
Non-Final Office Action dated Dec. 12, 2016, issued in connection with U.S. Appl. No. 15/098,718, filed Apr. 14, 2016, 11 pages.
Non-Final Office Action dated Jan. 13, 2017, issued in connection with U.S. Appl. No. 15/098,805, filed Apr. 14, 2016, 11 pages.
Non-Final Office Action dated Apr. 19, 2017, issued in connection with U.S. Appl. No. 15/131,776, filed Apr. 18, 2016, 12 pages.
Non-Final Office Action dated Jul. 25, 2017, issued in connection with U.S. Appl. No. 15/273,679, filed Jul. 22, 2016, 11 pages.
Non-Final Office Action dated Jan. 26, 2017, issued in connection with U.S. Appl. No. 15/098,867, filed Apr. 14, 2016, 16 pages.
Non-Final Office Action dated Jun. 30, 2017, issued in connection with U.S. Appl. No. 15/277,810, filed Sep. 27, 2016, 13 pages.
Notice of Allowance dated Jul. 12, 2017, issued in connection with U.S. Appl. No. 15/098,805, filed Apr. 14, 2016, 8 pages.
Notice of Allowance dated Aug. 14, 2017, issued in connection with U.S. Appl. No. 15/098,867, filed Apr. 14, 2016, 10 pages.
Notice of Allowance dated Feb. 14, 2017, issued in connection with U.S. Appl. No. 15/229,855, filed Aug. 5, 2016, 11 pages.
Notice of Allowance dated Jun. 14, 2017, issued in connection with U.S. Appl. No. 15/282,554, filed Sep. 30, 2016, 11 pages.
Notice of Allowance dated Aug. 16, 2017, issued in connection with U.S. Appl. No. 15/098,892, filed Apr. 14, 2016, 9 pages.
Notice of Allowance dated Aug. 17, 2017, issued in connection with U.S. Appl. No. 15/131,244, filed Apr. 18, 2016, 9 pages.
Notice of Allowance Aug. 22, 2017, issued in connection with U.S. Appl. No. 15/273,679, filed Sep. 22, 2016, 5 pages.
Palm, Inc., "Handbook for the Palm VII Handheld," May 2000, 311 pages.
Presentations at WinHEC 2000, May 2000, 138 pages.
United States Patent and Trademark Office, U.S. Appl. No. 60/490,768 filed Jul. 28, 2003, entitled "Method for synchronizing audio playback between multiple networked devices," 13 pages.
United States Patent and Trademark Office, U.S. Appl. No. 60/825,407 filed Sep. 12, 2006, entitled "Controlling and manipulating groupings in a multi-zone music or media system," 82 pages.
UPnP; "Universal Plug and Play Device Architecture," Jun. 8, 2000; version 1.0; Microsoft Corporation; pp. 1-54.
European Patent Office, European Extended Search Report dated Oct. 30, 2017, issued in connection with EP Application No. 17174435.2, 11 pages.
Final Office Action dated Oct. 6, 2017, issued in connection with U.S. Appl. No. 15/098,760, filed Apr. 14, 2016, 25 pages.
Fiorenza Arisio et al. "Deliverable 1.1 User Study, analysis of requirements and definition of the application task," May 31, 2012, http://dirha.fbk.eu/sites/dirha.fbk.eu/files/docs/DIRHA_D1.1., 31 pages.
Freiberger, Karl, "Development and Evaluation of Source Localization Algorithms for Coincident Microphone Arrays," Diploma Thesis, Apr. 1, 2010, 106 pages.
International Searching Authority, International Search Report and Written Opinion dated Nov. 22, 2017, issued in connection with International Application No. PCT/US2017/054063, filed Sep. 28, 2017, 11 pages.
International Searching Authority, International Search Report and Written Opinion dated Oct. 23, 2017, issued in connection with International Application No. PCT/US2017/042170, filed on Jul. 14, 2017, 15 pages.
International Searching Authority, International Search Report and Written Opinion dated Oct. 24, 2017, issued in connection with International Application No. PCT/US2017/042227, filed on Jul. 14, 2017, 16 pages.
Morales-Cordovilla et al. "Room Localization for Distant Speech Recognition," Proceedings of Interspeech 2014, Sep. 14, 2014, 4 pages.
Non-Final Office Action dated Nov. 2, 2017, issued in connection with U.S. Appl. No. 15/584,782, filed May 2, 2017, 11 pages.
Non-Final Office Action dated Jan. 10, 2018, issued in connection with U.S. Appl. No. 15/098,718, filed Apr. 14, 2016, 15 pages.
Non-Final Office Action dated Jan. 10, 2018, issued in connection with U.S. Appl. No. 15/229,868, filed Aug. 5, 2016, 13 pages.
Non-Final Office Action dated Jan. 10, 2018, issued in connection with U.S. Appl. No. 15/438,725, filed Feb. 21, 2017, 15 pages.
Non-Final Office Action dated Sep. 14, 2017, issued in connection with U.S. Appl. No. 15/178,180, filed Jun. 9, 2016, 16 pages.
Non-Final Office Action dated Feb. 20, 2018, issued in connection with U.S. Appl. No. 15/211,748, filed Jul. 15, 2016, 31 pages.
Non-Final Office Action dated Oct. 26, 2017, issued in connection with U.S. Appl. No. 15/438,744, filed Feb. 21, 2017, 12 pages.
Non-Final Office Action dated Feb. 6, 2018, issued in connection with U.S. Appl. No. 15/211,689, filed Jul. 15, 2016, 32 pages.
Non-Final Office Action dated Feb. 6, 2018, issued in connection with U.S. Appl. No. 15/237,133, filed Aug. 15, 2016, 6 pages.
Non-Final Office Action dated Sep. 6, 2017, issued in connection with U.S. Appl. No. 15/131,254, filed Apr. 18, 2016, 13 pages.
Notice of Allowance dated Dec. 4, 2017, issued in connection with U.S. Appl. No. 15/277,810, filed Sep. 27, 2016, 5 pages.
Notice of Allowance dated Dec. 13, 2017, issued in connection with U.S. Appl. No. 15/784,952, filed Oct. 16, 2017, 9 pages.
Notice of Allowance dated Dec. 15, 2017, issued in connection with U.S. Appl. No. 15/223,218, filed Jul. 29, 2016, 7 pages.
Notice of Allowance dated Jan. 22, 2018, issued in connection with U.S. Appl. No. 15/178,180, filed Jun. 9, 2016, 9 pages.
Notice of Allowance dated Dec. 29, 2017, issued in connection with U.S. Appl. No. 15/131,776, filed Apr. 18, 2016, 13 pages.
Tsiami et al. "Experiments in acoustic source localization using sparse arrays in adverse indoors environments", 2014 22nd European Signal Processing Conference, Sep. 1, 2014, 5 pages.
Vacher at al. "Recognition of voice commands by multisource ASR and noise cancellation in a smart home environment" Signal Processing Conference 2012 Proceedings of the 20th European, IEEE, Aug. 27, 2012, 5 pages.
Xiao et al. "A Learning-Based Approach to Direction of Arrival Estimation in Noisy and Reverberant Environments," 2015 IEEE International Conference on Acoustics, Speech and Signal Processing, Apr. 19, 2015, 5 pages.

* cited by examiner

COMPENSATION FOR SPEAKER NONLINEARITIES

CROSS-REFERENCE TO RELATED APPLICATIONS

This application claims the benefit of priority under 35 USC § 119(e) to U.S. Provisional Application Ser. No. 62/298,433 filed Feb. 22, 2016 and entitled "Room-corrected Voice Detection." This application is related to (i) U.S. Provisional Application No. 62/312,350, filed on Mar. 23, 2016, and entitled "Voice Control of a Media Playback System", (ii) U.S. Provisional Application No. 62/298,418, filed on Feb. 22, 2016, and entitled "Audio Response Playback", (iii) U.S. Provisional Application No. 62/298,425, filed on Feb. 22, 2016, and entitled "Music Service Selection", (iv) U.S. Provisional Application No. 62/298,350, filed on Feb. 22, 2016, and entitled "Metadata Exchange Involving a Networked Playback System and a Networked Microphone System", (v) U.S. Provisional Application No. 62/298,388, filed on Feb. 22, 2016, and entitled "Handling of Loss of Pairing Between Networked Devices," (vi) U.S. Provisional Application No. 62/298,410, filed on Feb. 22, 2016, and entitled "Default Playback Device(s)", (vii) U.S. Provisional Application No. 62/298,439, filed on Feb. 22, 2016, and entitled "Content Mixing", and (viii) U.S. Provisional Application No. 62/298,393, filed on Feb. 22, 2016, and entitled "Action Based on User ID", and (ix) U.S. application Ser. No. 15/438,744 filed on Feb. 21, 2017 and entitled "Sensor on Moving Component of Transducer." The contents of each of these applications are herein incorporated by reference in their entirety.

FIELD OF THE DISCLOSURE

The disclosure is related to consumer goods and, more particularly, to methods, systems, products, features, services, and other elements directed to media playback or some aspect thereof.

BACKGROUND

Options for accessing and listening to digital audio in an out-loud setting were limited until 2003, when SONOS, Inc. filed for one of its first patent applications, entitled "Method for Synchronizing Audio Playback between Multiple Networked Devices," and began offering a media playback system for sale in 2005. The Sonos Wireless HiFi System enables people to experience music from many sources via one or more networked playback devices. Through a software control application installed on a smartphone, tablet, or computer, one can play what he or she wants in any room that has a networked playback device. Additionally, using the controller, for example, different songs can be streamed to each room with a playback device, rooms can be grouped together for synchronous playback, or the same song can be heard in all rooms synchronously.

Given the ever growing interest in digital media, there continues to be a need to develop consumer-accessible technologies to further enhance the listening experience.

BRIEF DESCRIPTION OF THE DRAWINGS

Features, aspects, and advantages of the presently disclosed technology may be better understood with regard to the following description, appended claims, and accompanying drawings where:

Figure 1:
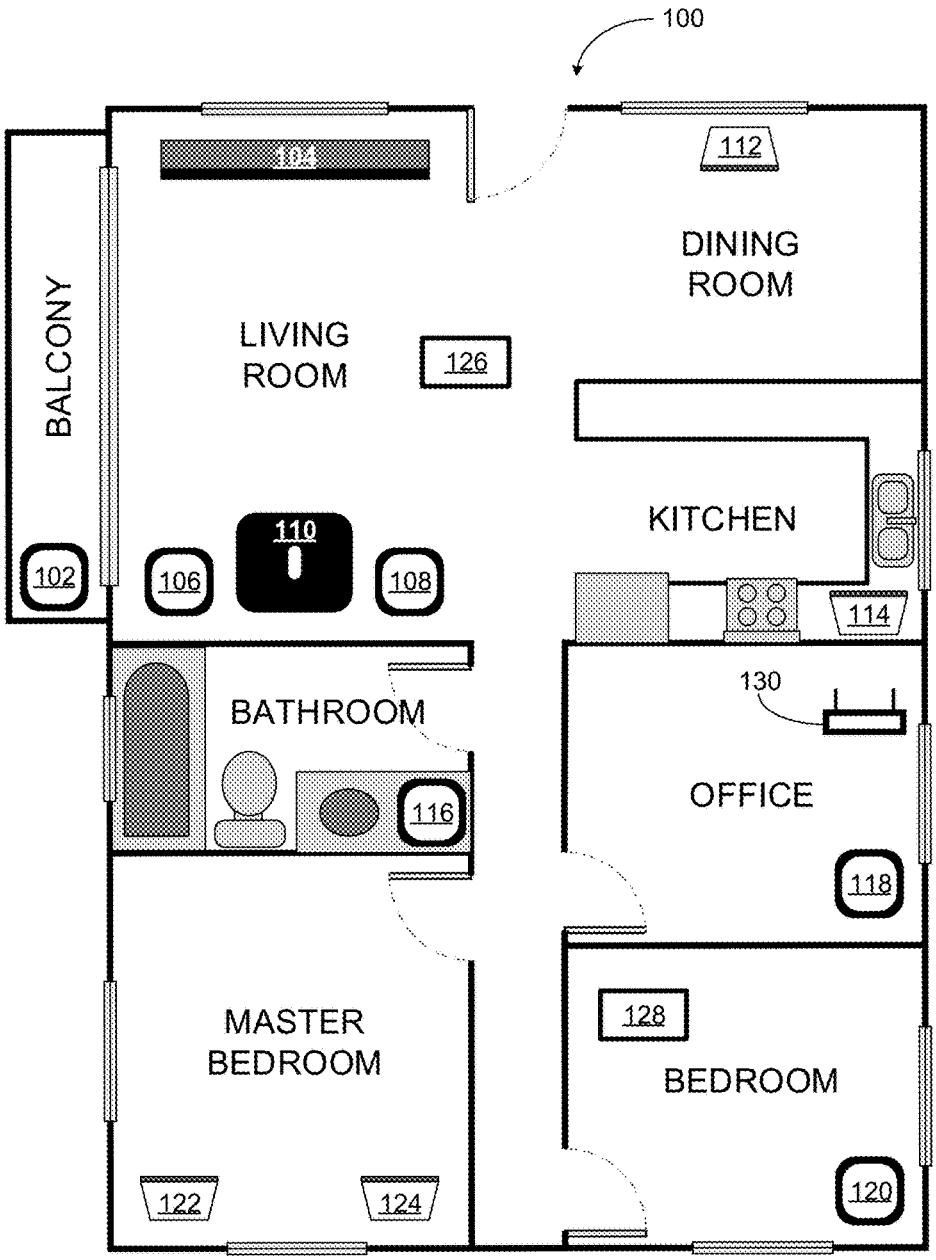
FIG. 1 shows an example media playback system configuration in which certain embodiments may be practiced.

The drawings are for purpose of illustrating example embodiments, but it is understood that the inventions are not limited to the arrangements and instrumentality shown in the drawings.

DETAILED DESCRIPTION

I. Overview

An audio playback environment may have an audio playback device and a network microphone device (NMD). The audio playback device nay play back audio from a radio, television, and/or an internet music source. The network microphone device may receive, via a microphone, a voice input from a user in the audio playback environment and facilitate processing of the voice input.

The voice input may take a variety of forms. For example, the voice input may be a command to change operation of the audio playback device. The change might be to increase a volume of the audio playback device and/or to play certain music such as "Track 1 from Album 1." As another example, the voice input may be a request for information such as "What time is it?" or "What is the weather tomorrow?". The NMD may convert the voice input into a microphone input signal representative of the voice input. The microphone input signal may be processed by the NMD, by other NMD in the audio playback environment, and/or some device remote to the NMD to clean up the voice input (e.g., remove noise or acoustics associated with the audio playback environment), interpret the voice input associated with the microphone input signal and/or perform an action associated with the voice input. The action might be to increase the volume of the playback device or provide an audible response via the NMD or audio playback device such as "The weather is sunny tomorrow."

The audio playback device may be located within acoustic proximity to the NMD. As a result, the audio playback device may be playing back audio at a same time the NMD receives the voice input, and signal received at the microphone of the NMD may include a voice input along with at least a portion of the audio being simultaneously played back by the audio playback device. Self-sound suppression is a process of isolating the voice input in the signal received at the microphone from the audio being played back. The self-sound suppression isolates the voice input from the audio playing back so that the voice input can be more reliably interpreted. Self-sound suppression may reduce a need to reduce an overall volume output level of the audio playback device when a voice input is detected (sometimes referred to as "ducking"—see also U.S. Provisional Application No. 62/298,439, filed on Feb. 22, 2016, and entitled "Content Mixing").

A transfer function may represent a difference between a given audio signal to be played by the audio playback device and a given signal received at the microphone of the NMD when the audio playback device plays the given audio signal. The transfer function may take the form of a frequency response. In some examples, the transfer function may represent an acoustic coupling between the audio playback device and NMD.

The transfer function may be applied to an audio signal to be played back by the audio playback device in self-sound suppression. The output of the transfer function may represent how the audio would be heard at the microphone. The microphone may also receive a voice input along with at least a portion of the audio being simultaneously played back by the audio playback device. The audio and voice input may be represented as a microphone input signal. The output from the transfer function may be subtracted from the microphone input signal to isolate the voice input. However, the process of isolating the voice input does not account for nonlinearities associated with the audio playback device, e.g., nonlinear audio effects output by the audio playback device such as intermodulation distortion (ID). Accordingly, all or most audio played by the audio playback device may not be eliminated from the microphone input signal. This may make subsequent processing of the microphone input to interpret the voice input more difficult.

In certain embodiments, nonlinearities associated with the audio playback device may be considered in recovering a voice input from a microphone input signal received by the NMD when audio is also being played back by the audio playback device in acoustic proximity to an NMD. A model of nonlinear audio effects, along with an improved transfer function, may be used to better isolate the voice input from a microphone input signal. Additionally, or alternatively, the model may be used to precompensate an audio signal to be played back by the playback device for nonlinear audio effects, such as distortion, thereby improving accuracy of self-sound suppression with an added benefit of improving sound quality. In this regard, use of the model in self-sound suppression allows for more reliably redacting audio being played back by an audio playback device from the microphone input signal of an NMD. The improved self-sound suppression may facilitate reliable voice processing of the voice input.

The improved self-sound suppression may be applied to a time stabilized audio signal (also referred to herein as a tapped audio signal). The audio signal may be time-stabilized when any further processing in an audio signal pathway of the audio playback device until output of audio by the audio playback device is not based on a function of time. In other words, characteristics of the tapped signal may be known.

A transfer function may be defined which characterizes a relative frequency response between a given time stabilized audio signal and a given microphone input signal when an audio playback device plays audio defined by the time stabilized audio signal. The transfer function may be defined during a training stage or predefined. The transfer function may be applied to the time stabilized audio signal to output a signal indicative of how the time stabilized audio signal is heard by the microphone.

The transfer function may not account for any nonlinear audio effects resulting from the nonlinearities of the audio playback device. As a result, a model may be defined which outputs a time dependent frequency response or a mathematical representation of the nonlinear audio effects of the audio playback device. The non-linear audio effect may be distortion, specifically intermodulation distortion. In some examples, the model may be based on a function of position of a moving component of a transducer of the audio playback device. To determine this position, a sensor may be embedded in a moving component of a speaker. For example, the sensor may be force compact sensor such a micro-electro-mechanical device such as a MEMS accelerometer. The sensor may measure acceleration of the moving part of the transducer which is in turn used to determine the position of the moving component of the transducer.

The model may be used to account for nonlinear audio effects of the audio playback device. For example, a time stabilized audio signal may be input into the model and the model may output a time dependent frequency response which is applied to a frequency domain representation of the time stabilized audio signal (e.g., FFT). The time dependent frequency response may improve the redaction, e.g., isolation of voice input, beyond that of applying the transfer function. The signal that remains (e.g., voice input) after such processing may be converted to text by the NMD or passed to a voice processing device.

In some embodiments, the output of the model may be used to precompensate the time stabilized audio signal. For instance, the output of the model may be subtracted from the time stabilized audio signal to produce a precompensated signal. The precompensated signal may then be played back by the audio playback device. The precompensation may result in any nonlinearities introduced by the transducer being substantially cancelled out by the precompensation. In turn, because the audio played by the playback device may not have much nonlinear audio effects, the microphone input signal may not receive much nonlinear audio effects from the audio and a processing device need not to account for the nonlinear audio effects in the self-sound suppression.

Further, by precompensating the time stabilized audio signal, quality of sound reproduction may be improved since the nonlinear audio effects may be lessened in the audio output by the audio playback device.

The disclosed self-sound suppression may be performed in a variety of audio playback environments including bonded zones, zone groups, environments with multiple NMDs, and environments with multiple playback devices, etc. as described in further detail herein.

Moving on from the above illustration, an example embodiment may be a device comprising: a processor; memory; and computer instructions stored in the memory and executable by the processor to cause the processor to: receive a first signal indicative of audio to be played by a speaker and a second signal which comprises (i) a voice input received by a microphone and (ii) at least a portion of the audio played by the speaker at a same time that the microphone receives the voice input; based on the first signal, determine nonlinearities output by the speaker which played the audio; and remove at least the nonlinearities from the second signal to output a third signal comprising substantially the voice input received at the microphone. Determining the nonlinearities output by the speaker which played the audio may comprise inputting a representation of the first signal into a model which outputs an indication of a frequency response which changes over time, the frequency response representing nonlinear audio effects output by the speaker. Nonlinear audio effects may comprise intermodulation distortion of the speaker. The model may be based on measurement of a position of a moving component of the speaker. Removing at least the nonlinearities from the second signal to output a third signal may comprise determining a compensated audio signal based on the first signal and the nonlinear audio effects output by the speaker, wherein the compensated audio signal characterizes how the audio played by the speaker sounds at the microphone. Removing at least the nonlinearities from the second signal to output a third signal may comprise applying a transfer function to the first audio signal wherein the transfer function is a relative frequency response between a fourth signal indicative of second audio to be played by the speaker and a fifth audio signal received at the microphone when the second audio is played. The microphone may be located within a given distance from speaker, wherein at the given distance the microphone detects the audio played by the speaker. The device may further comprise computer instructions for converting the voice input in the third signal into text. The first signal may be tapped from a signal processing pathway associated with the speaker after a time varying filter is applied to the first signal.

Another example embodiment may be a method comprising: receiving a first signal indicative of audio to be played by a speaker and a second signal which comprises (i) a voice input received by a microphone and (ii) at least a portion of the audio played by the speaker at a same time that the microphone receives the voice input; based on the first signal, determining nonlinearities output by the speaker which played the audio; and removing at least the nonlinearities from the second signal to output a third signal comprising substantially the voice input received at the microphone. Determining the nonlinearities output by the speaker which played the audio may comprise inputting a representation of the first signal into a model which outputs an indication of a frequency response which changes over time, the frequency response representing nonlinear audio effects output by the speaker. Nonlinear audio effects may comprise intermodulation distortion of the speaker. The model may be based on measurement of a position of a moving component of the speaker. Removing at least the nonlinearities from the second signal to output a third signal may comprise determining a compensated audio signal based on the first signal and the nonlinear audio effects output by the speaker, wherein the compensated audio signal characterizes how the audio played by the speaker sounds at the microphone. Removing at least the nonlinearities from the second signal to output a third signal may comprise applying a transfer function to the first audio signal wherein the transfer function is a relative frequency response between a fourth signal indicative of second audio to be played by the speaker and a fifth audio signal received at the microphone when the second audio is played. The microphone may be acoustically proximate to the speaker. The method may further comprise converting the voice input in the third signal into text. The first signal may be tapped from a signal processing pathway associated with the speaker after a time varying filter is applied to the first signal.

Yet another example embodiment may be a tangible non-transitory computer readable storage medium including instructions for execution by a processor, the instructions, when executed, cause the processor to implement a method comprising: receiving a first signal indicative of audio to be played by a speaker and a second signal which comprises (i) a voice input received by a microphone and (ii) at least a portion of the audio played by the speaker at a same time that the microphone receives the voice input; based on the first signal, determining nonlinearities output by the speaker which played the audio; and removing at least the nonlinearities from the second signal to output a third signal comprising substantially the voice input received at the microphone. Determining the nonlinearities output by the speaker which played the audio may comprise inputting a representation of the first signal into a model which outputs an indication of a frequency response which changes over time, the frequency response representing nonlinear audio effects output by the speaker. The tangible non-transitory computer readable storage medium may further comprise computer instructions to obtain acoustics of an environment in which the speaker is located; and apply the acoustics to the third signal comprising substantially the voice input received at the microphone.

While some examples described herein may refer to functions performed by given actors such as "users" and/or other entities, it should be understood that this is for purposes of explanation only. The claims should not be interpreted to require action by any such example actor unless explicitly required by the language of the claims themselves. It will be understood by one of ordinary skill in the art that this disclosure includes numerous other embodiments. Moreover, the examples described herein may extend to a multitude of embodiments formed by combining the example features in any suitable manner.

II. Example Operating Environment

FIG. 1 shows an example configuration of a media playback system 100 in which one or more embodiments disclosed herein may be practiced or implemented. The media playback system 100 as shown is associated with an example home environment having several rooms and spaces, such as for example, a master bedroom, an office, a dining room, and a living room. As shown in the example of FIG. 1, the media playback system 100 includes playback devices 102-124, control devices 126 and 128, and a wired or wireless network router 130.

Further discussions relating to the different components of the example media playback system 100 and how the different components may interact to provide a user with a media experience may be found in the following sections. While discussions herein may generally refer to the example media playback system 100, technologies described herein are not limited to applications within, among other things, the home environment as shown in FIG. 1. For instance, the technologies described herein may be useful in environments where multi-zone audio may be desired, such as, for example, a commercial setting like a restaurant, mall or airport, a vehicle like a sports utility vehicle (SUV), bus or car, a ship or boat, an airplane, and so on.

a. Example Playback Devices

Figure 2:
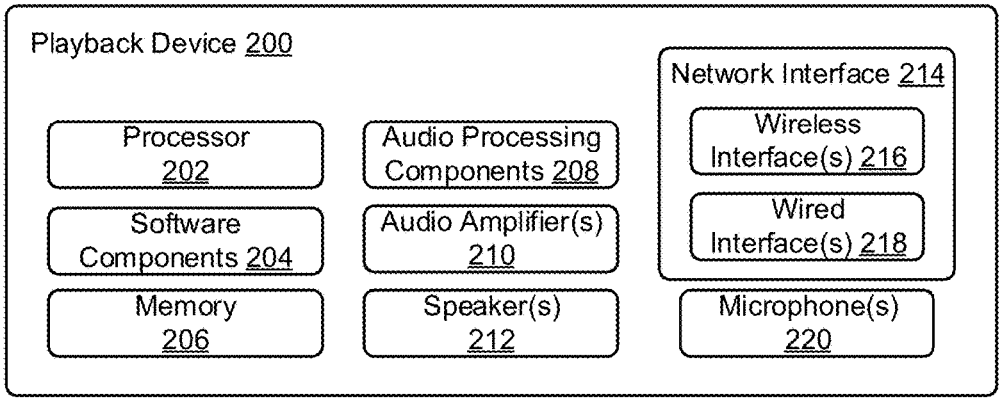
FIG. 2 shows a functional block diagram of an example playback device.

FIG. 2 shows a functional block diagram of an example playback device 200 that may be configured to be one or more of the playback devices 102-124 of the media playback system 100 of FIG. 1. The playback device 200 may include a processor 202, software components 204, memory 206, audio processing components 208, audio amplifier(s) 210, speaker(s) 212, a network interface 214 including wireless interface(s) 216 and wired interface(s) 218, and microphone(s) 220. In one case, the playback device 200 may not include the speaker(s) 212, but rather a speaker interface for connecting the playback device 200 to external speakers. In another case, the playback device 200 may include neither the speaker(s) 212 nor the audio amplifier(s) 210, but rather an audio interface for connecting the playback device 200 to an external audio amplifier or audio-visual receiver.

In one example, the processor 202 may be a clock-driven computing component configured to process input data according to instructions stored in the memory 206. The memory 206 may be a tangible computer-readable medium configured to store instructions executable by the processor 202. For instance, the memory 206 may be data storage that can be loaded with one or more of the software components 204 executable by the processor 202 to achieve certain functions. In one example, the functions may involve the playback device 200 retrieving audio data from an audio source or another playback device. In another example, the functions may involve the playback device 200 sending audio data to another device or playback device on a network. In yet another example, the functions may involve pairing of the playback device 200 with one or more playback devices to create a multi-channel audio environment.

Certain functions may involve the playback device 200 synchronizing playback of audio content with one or more other playback devices. During synchronous playback, a listener will preferably not be able to perceive time-delay differences between playback of the audio content by the playback device 200 and the one or more other playback devices. U.S. Pat. No. 8,234,395 entitled, "System and method for synchronizing operations among a plurality of independently clocked digital data processing devices," which is hereby incorporated by reference, provides in more detail some examples for audio playback synchronization among playback devices.

The memory 206 may further be configured to store data associated with the playback device 200, such as one or more zones and/or zone groups the playback device 200 is a part of, audio sources accessible by the playback device 200, or a playback queue that the playback device 200 (or some other playback device) may be associated with. The data may be stored as one or more state variables that are periodically updated and used to describe the state of the playback device 200. The memory 206 may also include the data associated with the state of the other devices of the media system, and shared from time to time among the devices so that one or more of the devices have the most recent data associated with the system. Other embodiments are also possible.

The audio processing components 208 may include one or more digital-to-analog converters (DAC), an audio preprocessing component, an audio enhancement component or a digital signal processor (DSP), and so on. In one embodiment, one or more of the audio processing components 208 may be a subcomponent of the processor 202. In one example, audio content may be processed and/or intentionally altered by the audio processing components 208 to produce audio signals. The produced audio signals may then be provided to the audio amplifier(s) 210 for amplification and playback through speaker(s) 212. Particularly, the audio amplifier(s) 210 may include devices configured to amplify audio signals to a level for driving one or more of the speakers 212. The speaker(s) 212 may include an individual transducer (e.g., a "driver") or a complete speaker system involving an enclosure with one or more drivers. A particular driver of the speaker(s) 212 may include, for example, a subwoofer (e.g., for low frequencies), a mid-range driver (e.g., for middle frequencies), and/or a tweeter (e.g., for high frequencies). In some cases, each transducer in the one or more speakers 212 may be driven by an individual corresponding audio amplifier of the audio amplifier(s) 210. In addition to producing analog signals for playback by the playback device 200, the audio processing components 208 may be configured to process audio content to be sent to one or more other playback devices for playback.

Audio content to be processed and/or played back by the playback device 200 may be received from an external source, such as via an audio line-in input connection (e.g., an auto-detecting 3.5 mm audio line-in connection) or the network interface 214.

The network interface 214 may be configured to facilitate a data flow between the playback device 200 and one or more other devices on a data network. As such, the playback device 200 may be configured to receive audio content over the data network from one or more other playback devices in communication with the playback device 200, network devices within a local area network, or audio content sources over a wide area network such as the Internet. In one example, the audio content and other signals transmitted and received by the playback device 200 may be transmitted in the form of digital packet data containing an Internet Protocol (IP)-based source address and IP-based destination addresses. In such a case, the network interface 214 may be configured to parse the digital packet data such that the data destined for the playback device 200 is properly received and processed by the playback device 200.

As shown, the network interface 214 may include wireless interface(s) 216 and wired interface(s) 218. The wireless interface(s) 216 may provide network interface functions for the playback device 200 to wirelessly communicate with other devices (e.g., other playback device(s), speaker(s), receiver(s), network device(s), control device(s) within a data network the playback device 200 is associated with) in accordance with a communication protocol (e.g., any wireless standard including IEEE 802.11a, 802.11b, 802.11g, 802.11n, 802.11ac, 802.15, 4G mobile communication standard, and so on). The wired interface(s) 218 may provide network interface functions for the playback device 200 to communicate over a wired connection with other devices in accordance with a communication protocol (e.g., IEEE 802.3). While the network interface 214 shown in FIG. 2 includes both wireless interface(s) 216 and wired interface(s) 218, the network interface 214 may in some embodiments include only wireless interface(s) or only wired interface(s).

The microphone(s) 220 may be arranged to detect sound in the environment of the playback device 200. For instance, the microphone(s) may be mounted on an exterior wall of a housing of the playback device. The microphone(s) may be any type of microphone now known or later developed such as a condenser microphone, electret condenser microphone, or a dynamic microphone. The microphone(s) may be sensitive to a portion of the frequency range of the speaker(s) 220. One or more of the speaker(s) 220 may operate in reverse as the microphone(s) 220. In some aspects, the playback device 200 might not include the microphone(s) 220.

In one example, the playback device 200 and one other playback device may be paired to play two separate audio components of audio content. For instance, playback device 200 may be configured to play a left channel audio component, while the other playback device may be configured to play a right channel audio component, thereby producing or enhancing a stereo effect of the audio content. The paired playback devices (also referred to as "bonded playback devices") may further play audio content in synchrony with other playback devices.

In another example, the playback device 200 may be sonically consolidated with one or more other playback devices to form a single, consolidated playback device. A consolidated playback device may be configured to process and reproduce sound differently than an unconsolidated playback device or playback devices that are paired, because a consolidated playback device may have additional speaker drivers through which audio content may be rendered. For instance, if the playback device 200 is a playback device designed to render low frequency range audio content (i.e. a subwoofer), the playback device 200 may be consolidated with a playback device designed to render full frequency range audio content. In such a case, the full frequency range playback device, when consolidated with the low frequency playback device 200, may be configured to render only the mid and high frequency components of audio content, while the low frequency range playback device 200 renders the low frequency component of the audio content. The consolidated playback device may further be paired with a single playback device or yet another consolidated playback device.

By way of illustration, SONOS, Inc. presently offers (or has offered) for sale certain playback devices including a "PLAY:1," "PLAY:3," "PLAY:5," "PLAYBAR," "CONNECT:AMP," "CONNECT," and "SUB." Any other past, present, and/or future playback devices may additionally or alternatively be used to implement the playback devices of example embodiments disclosed herein. Additionally, it is understood that a playback device is not limited to the example illustrated in FIG. 2 or to the SONOS product offerings. For example, a playback device may include a wired or wireless headphone. In another example, a playback device may include or interact with a docking station for personal mobile media playback devices. In yet another example, a playback device may be integral to another device or component such as a television, a lighting fixture, or some other device for indoor or outdoor use.

b. Example Playback Zone Configurations

Referring back to the media playback system 100 of FIG. 1, the environment may have one or more playback zones, each with one or more playback devices. The media playback system 100 may be established with one or more playback zones, after which one or more zones may be added, or removed to arrive at the example configuration shown in FIG. 1. Each zone may be given a name according to a different room or space such as an office, bathroom, master bedroom, bedroom, kitchen, dining room, living room, and/or balcony. In one case, a single playback zone may include multiple rooms or spaces. In another case, a single room or space may include multiple playback zones.

As shown in FIG. 1, the balcony, dining room, kitchen, bathroom, office, and bedroom zones each have one playback device, while the living room and master bedroom zones each have multiple playback devices. In the living room zone, playback devices 104, 106, 108, and 110 may be configured to play audio content in synchrony as individual playback devices, as one or more bonded playback devices, as one or more consolidated playback devices, or any combination thereof. Similarly, in the case of the master bedroom, playback devices 122 and 124 may be configured to play audio content in synchrony as individual playback devices, as a bonded playback device, or as a consolidated playback device.

In one example, one or more playback zones in the environment of FIG. 1 may each be playing different audio content. For instance, the user may be grilling in the balcony zone and listening to hip hop music being played by the playback device 102 while another user may be preparing food in the kitchen zone and listening to classical music being played by the playback device 114. In another example, a playback zone may play the same audio content in synchrony with another playback zone. For instance, the user may be in the office zone where the playback device 118 is playing the same rock music that is being playing by playback device 102 in the balcony zone. In such a case, playback devices 102 and 118 may be playing the rock music in synchrony such that the user may seamlessly (or at least substantially seamlessly) enjoy the audio content that is being played out-loud while moving between different playback zones. Synchronization among playback zones may be achieved in a manner similar to that of synchronization among playback devices, as described in previously referenced U.S. Pat. No. 8,234,395.

As suggested above, the zone configurations of the media playback system 100 may be dynamically modified, and in some embodiments, the media playback system 100 supports numerous configurations. For instance, if a user physically moves one or more playback devices to or from a zone, the media playback system 100 may be reconfigured to accommodate the change(s). For instance, if the user physically moves the playback device 102 from the balcony zone to the office zone, the office zone may now include both the playback device 118 and the playback device 102. The playback device 102 may be paired or grouped with the office zone and/or renamed if so desired via a control device such as the control devices 126 and 128. On the other hand, if the one or more playback devices are moved to a particular area in the home environment that is not already a playback zone, a new playback zone may be created for the particular area.

Further, different playback zones of the media playback system 100 may be dynamically combined into zone groups or split up into individual playback zones. For instance, the dining room zone and the kitchen zone 114 may be combined into a zone group for a dinner party such that playback devices 112 and 114 may render audio content in synchrony. On the other hand, the living room zone may be split into a television zone including playback device 104, and a listening zone including playback devices 106, 108, and 110, if the user wishes to listen to music in the living room space while another user wishes to watch television.

c. Example Control Devices

Figure 3:
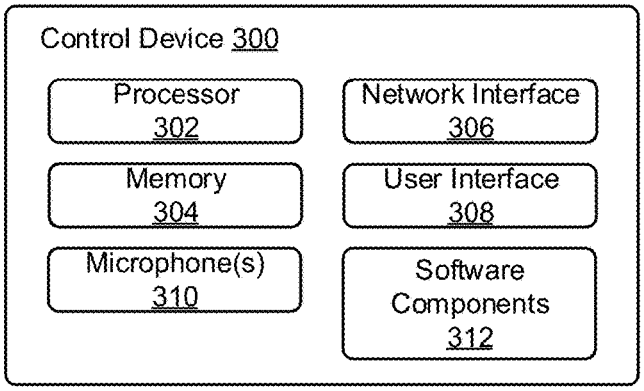
FIG. 3 shows a functional block diagram of an example control device.

FIG. 3 shows a functional block diagram of an example control device 300 that may be configured to be one or both of the control devices 126 and 128 of the media playback system 100. As shown, the control device 300 may include a processor 302, memory 304, a network interface 306, a user interface 308, microphone(s) 310, and software components 312. In one example, the control device 300 may be a dedicated controller for the media playback system 100. In another example, the control device 300 may be a network device on which media playback system controller application software may be installed, such as for example, an iPhone™, iPad™ or any other smart phone, tablet or network device (e.g., a networked computer such as a PC or Mac™).

The processor 302 may be configured to perform functions relevant to facilitating user access, control, and configuration of the media playback system 100. The memory 304 may be data storage that can be loaded with one or more of the software components executable by the processor 302 to perform those functions. The memory 304 may also be configured to store the media playback system controller application software and other data associated with the media playback system 100 and the user.

In one example, the network interface 306 may be based on an industry standard (e.g., infrared, radio, wired standards including IEEE 802.3, wireless standards including IEEE 802.11a, 802.11b, 802.11g, 802.11n, 802.11ac, 802.15, 4G mobile communication standard, and so on). The network interface 306 may provide a means for the control device 300 to communicate with other devices in the media playback system 100. In one example, data and information (e.g., such as a state variable) may be communicated between control device 300 and other devices via the network interface 306. For instance, playback zone and zone group configurations in the media playback system 100 may be received by the control device 300 from a playback device or another network device, or transmitted by the control device 300 to another playback device or network device via the network interface 306. In some cases, the other network device may be another control device.

Playback device control commands such as volume control and audio playback control may also be communicated from the control device 300 to a playback device via the network interface 306. As suggested above, changes to configurations of the media playback system 100 may also be performed by a user using the control device 300. The configuration changes may include adding/removing one or more playback devices to/from a zone, adding/removing one or more zones to/from a zone group, forming a bonded or consolidated player, separating one or more playback devices from a bonded or consolidated player, among others. Accordingly, the control device 300 may sometimes be referred to as a controller, whether the control device 300 is a dedicated controller or a network device on which media playback system controller application software is installed.

Control device 300 may include microphone(s) 310. Microphone(s) 310 may be arranged to detect sound in the environment of the control device 300. Microphone(s) 310 may be any type of microphone now known or later developed such as a condenser microphone, electret condenser microphone, or a dynamic microphone. The microphone(s) may be sensitive to a portion of a frequency range. Two or more microphones 310 may be arranged to capture location information of an audio source (e.g., voice, audible sound) and/or to assist in filtering background noise.

Figure 4:
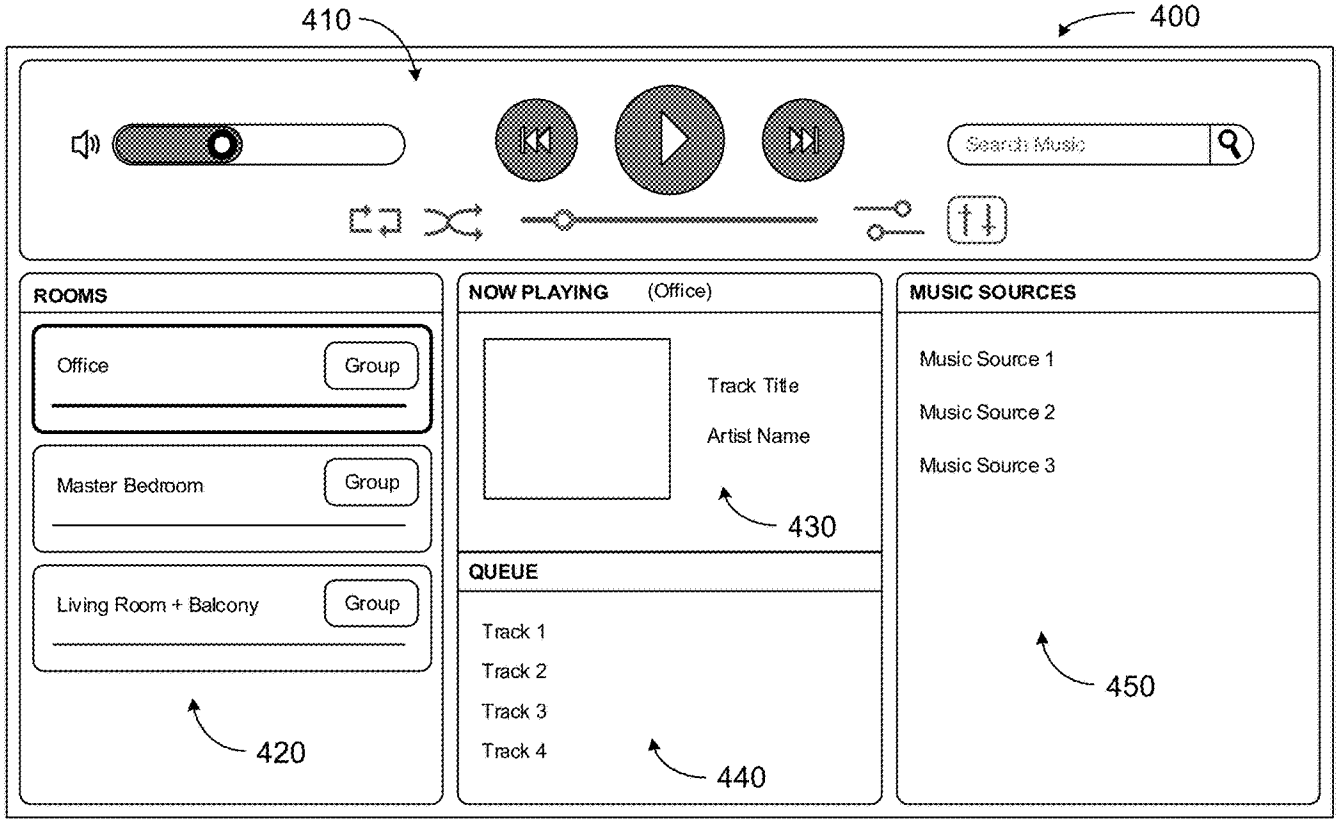
FIG. 4 shows an example controller interface.

The user interface 308 of the control device 300 may be configured to facilitate user access and control of the media playback system 100, by providing a controller interface such as the controller interface 400 shown in FIG. 4. The controller interface 400 includes a playback control region 410, a playback zone region 420, a playback status region 430, a playback queue region 440, and an audio content sources region 450. The user interface 400 as shown is just one example of a user interface that may be provided on a network device such as the control device 300 of FIG. 3 (and/or the control devices 126 and 128 of FIG. 1) and accessed by users to control a media playback system such as the media playback system 100. Other user interfaces of varying formats, styles, and interactive sequences may alternatively be implemented on one or more network devices to provide comparable control access to a media playback system.

The playback control region 410 may include selectable (e.g., by way of touch or by using a cursor) icons to cause playback devices in a selected playback zone or zone group to play or pause, fast forward, rewind, skip to next, skip to previous, enter/exit shuffle mode, enter/exit repeat mode, enter/exit cross fade mode. The playback control region 410 may also include selectable icons to modify equalization settings, and playback volume, among other possibilities.

The playback zone region 420 may include representations of playback zones within the media playback system 100. In some embodiments, the graphical representations of playback zones may be selectable to bring up additional selectable icons to manage or configure the playback zones in the media playback system, such as a creation of bonded zones, creation of zone groups, separation of zone groups, and renaming of zone groups, among other possibilities.

For example, as shown, a "group" icon may be provided within each of the graphical representations of playback zones. The "group" icon provided within a graphical representation of a particular zone may be selectable to bring up options to select one or more other zones in the media playback system to be grouped with the particular zone. Once grouped, playback devices in the zones that have been grouped with the particular zone will be configured to play audio content in synchrony with the playback device(s) in the particular zone. Analogously, a "group" icon may be provided within a graphical representation of a zone group. In this case, the "group" icon may be selectable to bring up options to deselect one or more zones in the zone group to be removed from the zone group. Other interactions and implementations for grouping and ungrouping zones via a user interface such as the user interface 400 are also possible. The representations of playback zones in the playback zone region 420 may be dynamically updated as playback zone or zone group configurations are modified.

The playback status region 430 may include graphical representations of audio content that is presently being played, previously played, or scheduled to play next in the selected playback zone or zone group. The selected playback zone or zone group may be visually distinguished on the user interface, such as within the playback zone region 420 and/or the playback status region 430. The graphical representations may include track title, artist name, album name, album year, track length, and other relevant information that may be useful for the user to know when controlling the media playback system via the user interface 400.

The playback queue region 440 may include graphical representations of audio content in a playback queue associated with the selected playback zone or zone group. In some embodiments, each playback zone or zone group may be associated with a playback queue containing information corresponding to zero or more audio items for playback by the playback zone or zone group. For instance, each audio item in the playback queue may comprise a uniform resource identifier (URI), a uniform resource locator (URL) or some other identifier that may be used by a playback device in the playback zone or zone group to find and/or retrieve the audio item from a local audio content source or a networked audio content source, possibly for playback by the playback device.

In one example, a playlist may be added to a playback queue, in which case information corresponding to each audio item in the playlist may be added to the playback queue. In another example, audio items in a playback queue may be saved as a playlist. In a further example, a playback queue may be empty, or populated but "not in use" when the playback zone or zone group is playing continuously streaming audio content, such as Internet radio that may continue to play until otherwise stopped, rather than discrete audio items that have playback durations. In an alternative embodiment, a playback queue can include Internet radio and/or other streaming audio content items and be "in use" when the playback zone or zone group is playing those items. Other examples are also possible.

When playback zones or zone groups are "grouped" or "ungrouped," playback queues associated with the affected playback zones or zone groups may be cleared or re-associated. For example, if a first playback zone including a first playback queue is grouped with a second playback zone including a second playback queue, the established zone group may have an associated playback queue that is initially empty, that contains audio items from the first playback queue (such as if the second playback zone was added to the first playback zone), that contains audio items from the second playback queue (such as if the first playback zone was added to the second playback zone), or a combination of audio items from both the first and second playback queues. Subsequently, if the established zone group is ungrouped, the resulting first playback zone may be re-associated with the previous first playback queue, or be associated with a new playback queue that is empty or contains audio items from the playback queue associated with the established zone group before the established zone group was ungrouped. Similarly, the resulting second playback zone may be re-associated with the previous second playback queue, or be associated with a new playback queue that is empty, or contains audio items from the playback queue associated with the established zone group before the established zone group was ungrouped. Other examples are also possible.

Referring back to the user interface 400 of FIG. 4, the graphical representations of audio content in the playback queue region 440 may include track titles, artist names, track lengths, and other relevant information associated with the audio content in the playback queue. In one example, graphical representations of audio content may be selectable to bring up additional selectable icons to manage and/or manipulate the playback queue and/or audio content represented in the playback queue. For instance, a represented audio content may be removed from the playback queue, moved to a different position within the playback queue, or selected to be played immediately, or after any currently playing audio content, among other possibilities. A playback queue associated with a playback zone or zone group may be stored in a memory on one or more playback devices in the playback zone or zone group, on a playback device that is not in the playback zone or zone group, and/or some other designated device.

The audio content sources region 450 may include graphical representations of selectable audio content sources from which audio content may be retrieved and played by the selected playback zone or zone group. Discussions pertaining to audio content sources may be found in the following section.

d. Example Audio Content Sources

As indicated previously, one or more playback devices in a zone or zone group may be configured to retrieve for playback audio content (e.g. according to a corresponding URI or URL for the audio content) from a variety of available audio content sources. In one example, audio content may be retrieved by a playback device directly from a corresponding audio content source (e.g., a line-in connection). In another example, audio content may be provided to a playback device over a network via one or more other playback devices or network devices.

Example audio content sources may include a memory of one or more playback devices in a media playback system such as the media playback system 100 of FIG. 1, local music libraries on one or more network devices (such as a control device, a network-enabled personal computer, or a networked-attached storage (NAS), for example), streaming audio services providing audio content via the Internet (e.g., the cloud), or audio sources connected to the media playback system via a line-in input connection on a playback device or network devise, among other possibilities.

In some embodiments, audio content sources may be regularly added or removed from a media playback system such as the media playback system 100 of FIG. 1. In one example, an indexing of audio items may be performed whenever one or more audio content sources are added, removed or updated. Indexing of audio items may involve scanning for identifiable audio items in all folders/directory shared over a network accessible by playback devices in the media playback system, and generating or updating an audio content database containing metadata (e.g., title, artist, album, track length, among others) and other associated information, such as a URI or URL for each identifiable audio item found. Other examples for managing and maintaining audio content sources may also be possible.

The above discussions relating to playback devices, controller devices, playback zone configurations, and media content sources provide only some examples of operating environments within which functions and methods described below may be implemented. Other operating environments and configurations of media playback systems, playback devices, and network devices not explicitly described herein may also be applicable and suitable for implementation of the functions and methods.

e. Example Plurality of Networked Devices

Figure 5:
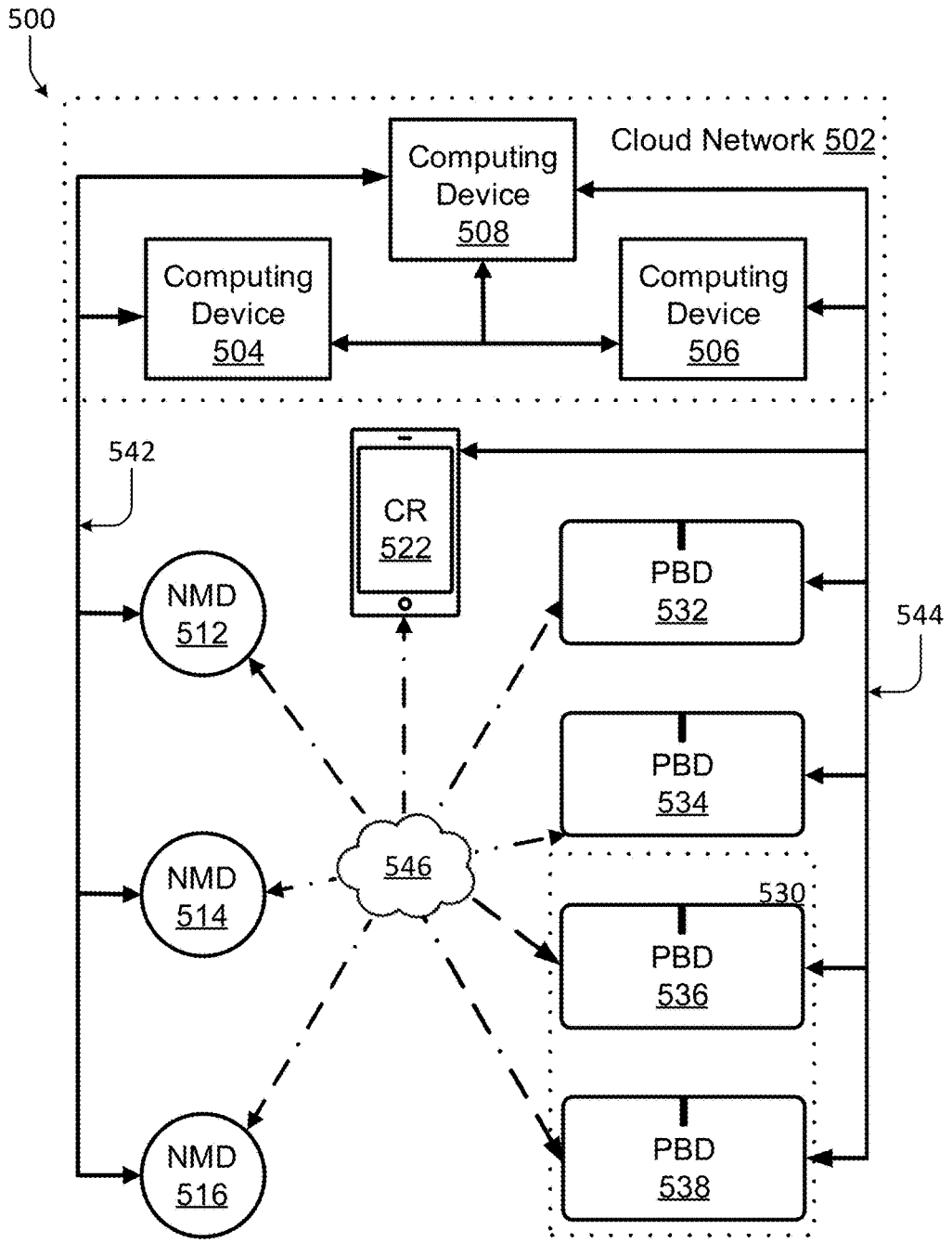
FIG. 5 shows an example plurality of network devices.

FIG. 5 shows an example plurality of devices 500 that may be configured to provide an audio playback experience based on voice control. One having ordinary skill in the art will appreciate that the devices shown in FIG. 5 are for illustrative purposes only, and variations including different and/or additional devices may be possible. As shown, the plurality of devices 500 includes computing devices 504, 506, and 508; network microphone devices (NMDs) 512, 514, and 516; playback devices (PBDs) 532, 534, 536, and 538; and a controller device (CR) 522.

Each of the plurality of devices 500 may be network-capable devices that can establish communication with one or more other devices in the plurality of devices according to one or more network protocols, such as NFC, Bluetooth, Ethernet, and IEEE 802.11, among other examples, over one or more types of networks, such as wide area networks (WAN), local area networks (LAN), and personal area networks (PAN), among other possibilities.

As shown, the computing devices 504, 506, and 508 may be part of a cloud network 502. The cloud network 502 may include additional computing devices. In one example, the computing devices 504, 506, and 508 may be different servers. In another example, two or more of the computing devices 504, 506, and 508 may be modules of a single server. Analogously, each of the computing device 504, 506, and 508 may include one or more modules or servers. For ease of illustration purposes herein, each of the computing devices 504, 506, and 508 may be configured to perform particular functions within the cloud network 502. For instance, computing device 508 may be a source of audio content for a streaming music service.

As shown, the computing device 504 may be configured to interface with NMDs 512, 514, and 516 via communication path 542. NMDs 512, 514, and 516 may be components of one or more "Smart Home" systems. In one case, NMDs 512, 514, and 516 may be physically distributed throughout a household, similar to the distribution of devices shown in FIG. 1. In another case, two or more of the NMDs 512, 514, and 516 may be physically positioned within relative close proximity of one another. Communication path 542 may comprise one or more types of networks, such as a WAN including the Internet, LAN, and/or PAN, among other possibilities.

In one example, one or more of the NMDs 512, 514, and 516 may be devices configured primarily for audio detection. In another example, one or more of the NMDs 512, 514, and 516 may be components of devices having various primary utilities. For instance, as discussed above in connection to FIGS. 2 and 3, one or more of NMDs 512, 514, and 516 may be the microphone(s) 220 of playback device 200 or the microphone(s) 310 of network device 300. Further, in some cases, one or more of NMDs 512, 514, and 516 may be the playback device 200 or network device 300. In an example, one or more of NMDs 512, 514, and/or 516 may include multiple microphones arranged in a microphone array.

As shown, the computing device 506 may be configured to interface with CR 522 and PBDs 532, 534, 536, and 538 via communication path 544. In one example, CR 522 may be a network device such as the network device 200 of FIG. 2. Accordingly, CR 522 may be configured to provide the controller interface 400 of FIG. 4. Similarly, PBDs 532, 534, 536, and 538 may be playback devices such as the playback device 300 of FIG. 3. As such, PBDs 532, 534, 536, and 538 may be physically distributed throughout a household as shown in FIG. 1. For illustration purposes, PBDs 536 and 538 may be part of a bonded zone 530, while PBDs 532 and 534 may be part of their own respective zones. As described above, the PBDs 532, 534, 536, and 538 may be dynamically bonded, grouped, unbonded, and ungrouped. Communication path 544 may comprise one or more types of networks, such as a WAN including the Internet, LAN, and/or PAN, among other possibilities.

In one example, as with NMDs 512, 514, and 516, CR 522 and PBDs 532, 534, 536, and 538 may also be components of one or more "Smart Home" systems. In one case, PBDs 532, 534, 536, and 538 may be distributed throughout the same household as the NMDs 512, 514, and 516. Further, as suggested above, one or more of PBDs 532, 534, 536, and 538 may be one or more of NMDs 512, 514, and 516.

The NMDs 512, 514, and 516 may be part of a local area network, and the communication path 542 may include an access point that links the local area network of the NMDs 512, 514, and 516 to the computing device 504 over a WAN (communication path not shown). Likewise, each of the NMDs 512, 514, and 516 may communicate with each other via such an access point.

Similarly, CR 522 and PBDs 532, 534, 536, and 538 may be part of a local area network and/or a local playback network as discussed in previous sections, and the communication path 544 may include an access point that links the local area network and/or local playback network of CR 522 and PBDs 532, 534, 536, and 538 to the computing device 506 over a WAN. As such, each of the CR 522 and PBDs 532, 534, 536, and 538 may also communicate with each over such an access point.

In one example, a single access point may include communication paths 542 and 544. In an example, each of the NMDs 512, 514, and 516, CR 522, and PBDs 532, 534, 536, and 538 may access the cloud network 502 via the same access point for a household.

As shown in FIG. 5, each of the NMDs 512, 514, and 516, CR 522, and PBDs 532, 534, 536, and 538 may also directly communicate with one or more of the other devices via communication means 546. Communication means 546 as described herein may involve one or more forms of communication between the devices, according to one or more network protocols, over one or more types of networks, and/or may involve communication via one or more other network devices. For instance, communication means 546 may include one or more of for example, Bluetooth™ (IEEE 802.15), NFC, Wireless direct, and/or Proprietary wireless, among other possibilities.

In one example, CR 522 may communicate with NMD 512 over Bluetooth™, and communicate with PBD 534 over another local area network. In another example, NMD 514 may communicate with CR 522 over another local area network, and communicate with PBD 536 over Bluetooth. In a further example, each of the PBDs 532, 534, 536, and 538 may communicate with each other according to a spanning tree protocol over a local playback network, while each communicating with CR 522 over a local area network, different from the local playback network. Other examples are also possible.

In some cases, communication means between the NMDs 512, 514, and 516, CR 522, and PBDs 532, 534, 536, and 538 may change depending on types of communication between the devices, network conditions, and/or latency demands. For instance, communication means 546 may be used when NMD 516 is first introduced to the household with the PBDs 532, 534, 536, and 538. In one case, the NMD 516 may transmit identification information corresponding to the NMD 516 to PBD 538 via NFC, and PBD 538 may in response, transmit local area network information to NMD 516 via NFC (or some other form of communication). However, once NMD 516 has been configured within the household, communication means between NMD 516 and PBD 538 may change. For instance, NMD 516 may subsequently communicate with PBD 538 via communication path 542, the cloud network 502, and communication path 544. In another example, the NMDs and PBDs may never communicate via local communications means 546. In a further example, the NMDs and PBDs may communicate primarily via local communications means 546. Other examples are also possible.

In an illustrative example, NMDs 512, 514, and 516 may be configured to receive voice inputs to control PBDs 532, 534, 536, and 538. The available control commands may include any media playback system controls previously discussed, such as playback volume control, playback transport controls, music source selection, and grouping, among other possibilities. In one instance, NMD 512 may receive a voice input to control one or more of the PBDs 532, 534, 536, and 538. In response to receiving the voice input, NMD 512 may transmit via communication path 542, the voice input to computing device 504 for processing. In one example, the computing device 504 may convert the voice input to an equivalent text command, and parse the text command to identify a command. Computing device 504 may then subsequently transmit the text command to the computing device 506. In another example, the computing device 504 may convert the voice input to an equivalent text command, and then subsequently transmit the text command to the computing device 506. The computing device 506 may then parse the text command to identify one or more playback commands.

For instance, if the text command is "Play 'Track 1' by 'Artist 1' from 'Streaming Service 1' in 'Zone 1'," The computing device 506 may identify (i) a URL for "Track 1" by "Artist 1" available from "Streaming Service 1," and (ii) at least one playback device in "Zone 1." In this example, the URL for "Track 1" by "Artist 1" from "Streaming Service 1" may be a URL pointing to computing device 508, and "Zone 1" may be the bonded zone 530. As such, upon identifying the URL and one or both of PBDs 536 and 538, the computing device 506 may transmit via communication path 544 to one or both of PBDs 536 and 538, the identified URL for playback. One or both of PBDs 536 and 538 may responsively retrieve audio content from the computing device 508 according to the received URL, and begin playing "Track 1" by "Artist 1" from "Streaming Service 1."

One having ordinary skill in the art will appreciate that the above is just one illustrative example, and that other implementations are also possible. In one case, operations performed by one or more of the plurality of devices 500, as described above, may be performed by one or more other devices in the plurality of device 500. For instance, the conversion from voice input to the text command may be alternatively, partially, or wholly performed by another device or devices, such as NMD 512, computing device 506, PBD 536, and/or PBD 538. Analogously, the identification of the URL may be alternatively, partially, or wholly performed by another device or devices, such as NMD 512, computing device 504, PBD 536, and/or PBD 538.

f. Example Network Microphone Device

Figure 6:
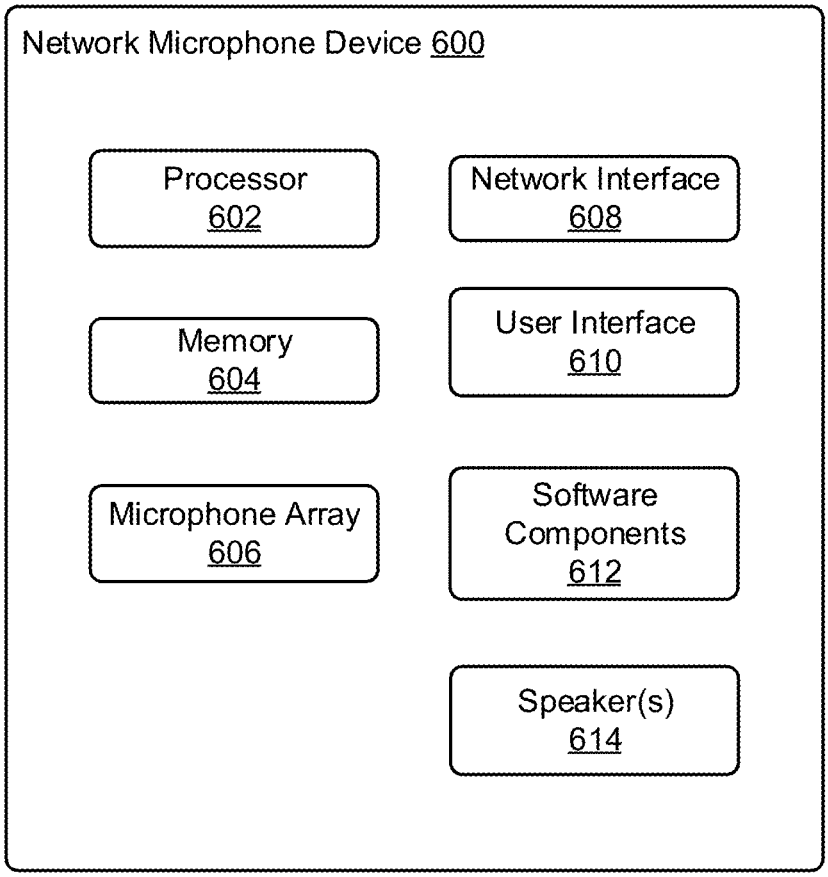
FIG. 6 shows a functional block diagram of an example network microphone device.

FIG. 6 shows a function block diagram of an example network microphone device 600 that may be configured to be one or more of NMDs 512, 514, and 516 of FIG. 5. As shown, the network microphone device 600 includes a processor 602, memory 604, a microphone array 606, a network interface 608, a user interface 610, software components 612, and speaker(s) 614. One having ordinary skill in the art will appreciate that other network microphone device configurations and arrangements are also possible. For instance, network microphone devices may alternatively exclude the speaker(s) 614 or have a single microphone instead of microphone array 606.

The processor 602 may include one or more processors and/or controllers, which may take the form of a general or special-purpose processor or controller. For instance, the processing unit 602 may include microprocessors, microcontrollers, application-specific integrated circuits, digital signal processors, and the like. The memory 604 may be data storage that can be loaded with one or more of the software components executable by the processor 602 to perform those functions. Accordingly, memory 604 may comprise one or more non-transitory computer-readable storage mediums, examples of which may include volatile storage mediums such as random access memory, registers, cache, etc. and non-volatile storage mediums such as read-only memory, a hard-disk drive, a solid-state drive, flash memory, and/or an optical-storage device, among other possibilities.

The microphone array 606 may be a plurality of microphones arranged to detect sound in the environment of the network microphone device 600. Microphone array 606 may include any type of microphone now known or later developed such as a condenser microphone, electret condenser microphone, or a dynamic microphone, among other possibilities. In one example, the microphone array may be arranged to detect audio from one or more directions relative to the network microphone device. The microphone array 606 may be sensitive to a portion of a frequency range. In one example, a first subset of the microphone array 606 may be sensitive to a first frequency range, while a second subset of the microphone array may be sensitive to a second frequency range. The microphone array 606 may further be arranged to capture location information of an audio source (e.g., voice, audible sound) and/or to assist in filtering background noise. Notably, in some embodiments the microphone array may consist of only a single microphone, rather than a plurality of microphones.

The network interface 608 may be configured to facilitate wireless and/or wired communication between various network devices, such as, in reference to FIG. 5, CR 522, PBDs 532-538, computing device 504-508 in cloud network 502, and other network microphone devices, among other possibilities. As such, network interface 608 may take any suitable form for carrying out these functions, examples of which may include an Ethernet interface, a serial bus interface (e.g., FireWire, USB 2.0, etc.), a chipset and antenna adapted to facilitate wireless communication, and/or any other interface that provides for wired and/or wireless communication. In one example, the network interface 608 may be based on an industry standard (e.g., infrared, radio, wired standards including IEEE 802.3, wireless standards including IEEE 802.11a, 802.11b, 802.11g, 802.11n, 802.11ac, 802.15, 4G mobile communication standard, and so on).

The user interface 610 of the network microphone device 600 may be configured to facilitate user interactions with the network microphone device. In one example, the user interface 608 may include one or more of physical buttons, graphical interfaces provided on touch sensitive screen(s) and/or surface(s), among other possibilities, for a user to directly provide input to the network microphone device 600. The user interface 610 may further include one or more of lights and the speaker(s) 614 to provide visual and/or audio feedback to a user. In one example, the network microphone device 600 may further be configured to playback audio content via the speaker(s) 614. In this case, the NMD 600 may also include the functions and features associated with the playback device 200.

III. Example Systems and Methods for Compensating for Speaker Nonlinearities

A system may have a linear response and/or non-linear response. In simplest terms, a system may have a linear response if a sine wave injected into a system at a given frequency responds at that same frequency with a certain magnitude and a certain phase angle relative to the input. Also for a linear system, doubling the amplitude of the input will double the amplitude of the output. On the other hand, a system may have a non-linear response instead of, or in addition to the linear response, if the system responds at a different frequency than the input such as twice the input frequency.

In the context of audio playback devices, an audio signal may be a signal representative of content to be played back by the audio playback device and the audio playback device may output audio based on the audio signal. A frequency response may be used to characterize dynamics of a speaker and/or transducer (the terms transducer and speaker are used herein interchangeably) of the audio playback device. The frequency response may define a magnitude and phase output by a system for a given input with a given frequency. However, the problem with using the frequency response is that it is a linear measurement which assumes that speakers perform linear transformations of the input audio signal. In reality, the audio playback device is a nonlinear device which outputs nonlinear audio effects such as distortion. As a result, characterizing the audio playback device with a frequency response is insufficient to reliably determine the real-world characteristics of the audio playback device.

Intermodulation distortion (ID) is an example of a nonlinear distortion output by the audio playback device. A transducer of the audio playback device typically has a voice coil. The voice coil is a coil of wire that produces a motive force to a cone by a reaction of a magnetic field to current passing through the coil. The movement of the cone may produce sound pressure waves associated with an input audio signal which has low and high frequency components. ID may be generated when the input audio signal drives the voice coil which in turn drives the cone beyond an equilibrium position. For example, the low frequency portions of the input signal may force the cone towards its limits of movement resulting in distortion of the sound pressure waves associated with the high frequencies portions of the input audio signal. The ID of the speaker may affect the quality of the audio played back.

Another example of a nonlinear audio effect is harmonic distortion. Harmonic distortion is a measure of power contained in harmonics of a fundamental frequency.

Self-sound suppression is a process of reducing or eliminating audio being played back by an audio playback device from a microphone signal which comprises the audio being played and a voice input simultaneously received when the audio is played. The voice input may be, for example, a voice command such as "Play Track 2" or some other speech while the audio playback device is simultaneously playing a song.

A transfer function may represent a difference in frequency response between a given audio signal to be played by the audio playback device and a given signal received at the microphone when the audio playback device plays audio associated with the given audio signal. The transfer function is typically pseudo-static in that it is updated at some time interval such as daily.

This transfer function may be used to perform self-sound suppression. The signal received at the microphone, e.g., a microphone input signal, may include a voice input along with at least a portion of the audio being simultaneously played back by the audio playback device. The voice input may be isolated from the audio being played back by applying the transfer function to the audio signal representative of the audio being simultaneously played back by the audio playback device. The output of the transfer function may represent how the audio played by the audio playback device would sound at the microphone when the audio signal is being played back. Then, this output may be subtracted from the microphone input signal to isolate the voice input.

In environments having an NMD and audio playback device playing back audio simultaneously, the nonlinear response of the audio playback device may affect accuracy in isolating the voice input from the audio also being played back at the same time the voice input is received at the microphone of the NMD. The transfer function may not contain any information about nonlinear audio effects resulting from the nonlinear frequency response of the audio playback device such as ID. As a result, the difference may not account for the ID or harmonic distortion of the audio playback device and accordingly all or most content played by the speaker may not be eliminated. This may make subsequent processing of the voice input, e.g., voice command detection or speech to text conversion, difficult.

In embodiments, a model of the nonlinear audio effects output by the audio playback device may be used to improve self-sound suppression when recovering a voice input in the presence of audio being played back by an audio playback device. In particular, the model may output a time dependent frequency response or a mathematical representation of the nonlinear audio effects of the audio playback device which when used with an improved transfer function better isolates the voice input. Additionally, or alternatively, the model may be used to precompensate the audio signal to be played back by the playback device for nonlinear audio effects, such as distortion, thereby improving accuracy of self-sound suppression with an added benefit of improving sound quality. In this regard, use of the model in self-sound suppression may allow for more reliably redacting audio being played back by an audio playback device from a voice input received by a microphone of an NMD. The improved self-suppression may facilitate reliable voice processing of the voice input, such as voice command detection or speech-to-text translation.

Figure 7:
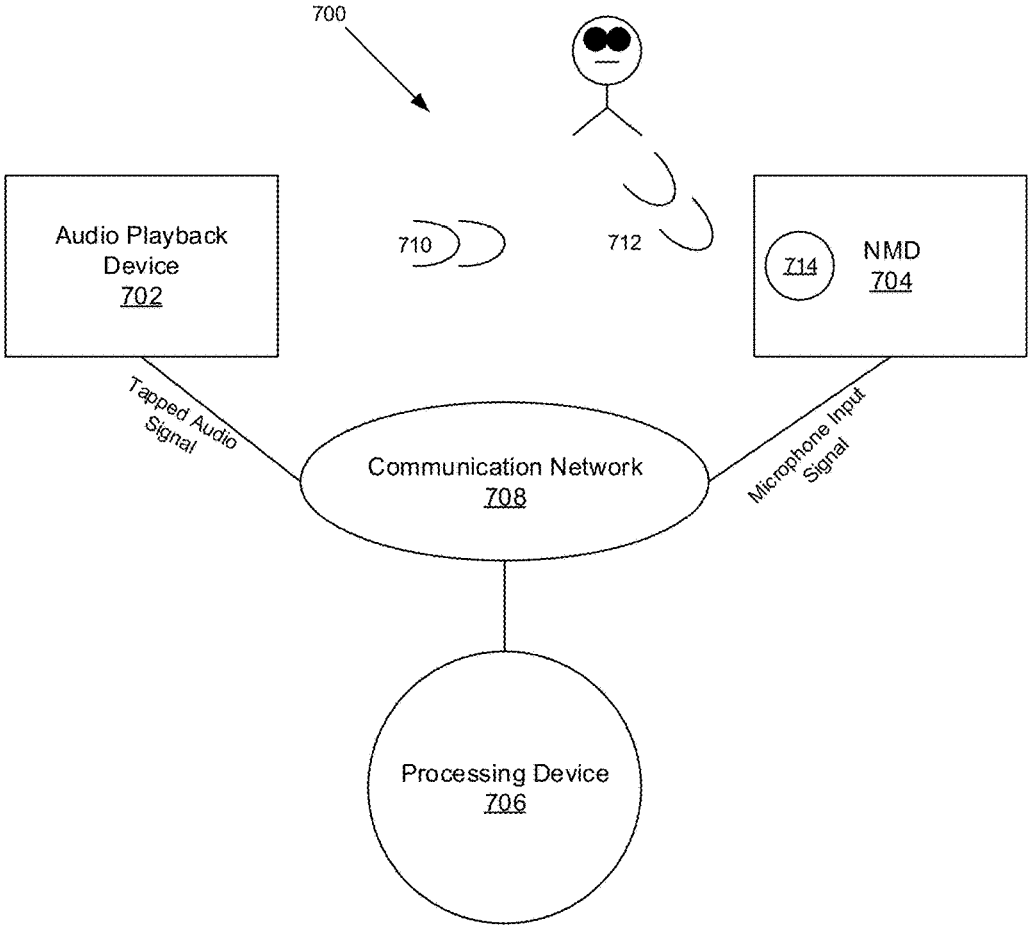
FIG. 7 shows an example listening environment in which self-sound suppression is performed.

FIG. 7 shows an example environment 700 in which self-sound suppression can be performed. The environment 700 may include an audio playback device 702, an NMD 704, and a processing device 706. The audio playback device 702 and NMD 704 may be communicatively coupled to the processing device 706 via a communication network 708 which may take the form of wireless links, wired links or a wireless or wired network such as a LAN, WAN, or cloud network. The audio playback device 702 and NMD 704 may be proximate to each other, whereas the processing device 706 may be located proximate or remote to the audio playback device 702 and NMD 704. Other variations are also possible.

The audio playback device 702 may receive an audio signal and play back audio associated with the audio signal. In one example, the audio signal may be a digital audio signal such as a packetized or non-packetized stream of audio from a music service, radio, or television, a digital audio file, an audio signal generated by the audio playback device 702 itself or a device connected to the audio playback device 702. The audio data may be sampled at a sampling rate and packetized into a packet and/or stream of packets. For example, the packet may comprise 128 bits of audio data.

In another example, the audio signal may be analog signal input from an auxiliary connection or a digital signal input from a USB connection. The audio signal may comprise frequency content that may generally range from 0 Hz to 20,000 Hz or some subset of this frequency range.

The audio playback device 702 may process the audio signal in an audio signal pathway of the audio playback device 702. The audio signal pathway may represent processing performed by the audio playback device 702 between input of the audio signal into the audio playback device 702 and playback of audio based on the audio signal. The processing may include filtering the audio signal and/or equalizing the audio signal.

The audio signal pathway may be tapped at a point in the audio signal pathway where the audio signal is time-stabilized. The audio signal may be time-stabilized when any further processing in the audio signal pathway until output of audio by the audio playback device 702 is not time varying. For example, applying a filter with a predetermined gain to the audio signal may be an example of processing that is not time varying. On the other hand, applying to the audio signal a filter with a gain that dynamically changes over time (or as a function of time) may be an example of processing that is time varying. The tap may take the form of a digital tap or an analog tap. The digital tap may be a tapping of the audio signal while in digital form. The analog tap may be a tapping of the audio signal in as an analog electrical signal, e.g., immediately before an analog filter pipeline. The audio filter pipeline may include filters which split up an analog version of the audio signal into two or more frequency ranges, so that each frequency range can be sent to drivers or tweeters that are designed for different frequency ranges. This time stabilized audio signal (e.g., tapped audio signal) may be sent to the processing device 706 via the communication network 708.

The NMD 704 may be acoustically proximate to the audio playback device. The NMD may be acoustically proximate when the microphone of the NMD is within a distance at which it can detect the audio that the audio playback device plays. The NMD 704 may receive the audio 710 played back by the audio playback device 702 at one or more microphones 714. Additionally, the NMD may receive a voice input 712. The voice input may be, for example, speech spoken within the environment 700 such as voice command.

In the case that the NMD 704 has one or more microphones 714, the microphones 714 may be oriented to cover a polar range. For example, the one or more microphones 714 may be oriented to receive audio in a 360 degree polar range around the NMD 704. In some examples, the audio playback device 702 may be the same device as the NMD 704, in which case the audio playback device 702 and the NMD 704 may not be coupled together via the communication network 708.

The audio 710 and the voice input 712 received by the NMD 704 may be processed. The audio input 710 and voice input 712 may be converted into a microphone input signal which may take the form of an analog signal. The NMD 704 may convert the analog signal to a digital signal by an analog to digital converter. The processing may also include removing artifacts such as reverberation from the microphone input signal. Reverberation is the persistence of sound caused when sound is reflected in a room causing a large number of reflections to build up and then decay as the sound is absorbed by the surfaces of objects in the space—which could include furniture, people, and air. The reverberation may show up on the microphone input as an artifact of a signal impulse response of the sound. The reverberation may be removed by locating a signal impulse response in the microphone input signal, locating a maximum peak in the signal impulse response, and processing up to and/or around the maximum peak where phase distortion is less while suppressing the other peaks where phase distortion may be more. The reverberation may be removed in other ways was well.

In some examples, the microphone input received by each microphone of two or more microphones may be combined before being processed. The combining may involve weighting one or more of a respective microphone input signal received by a microphone and then mixing the weighted microphone inputs. The microphone input signal may be processed in other ways as well.

The NMD 704 may send the microphone input signal to the processing device 706 via the communication network 708. The processing device 706 may comprise hardware or hardware and software (e.g., processor and computer instructions) for suppressing the audio 710 from the microphone input signal to facilitate recovery of the voice input 712. The processing device 706 may be remote to the NMD 704 and/or audio playback device 702. For example, the processing device 706 may be one or more of the computing devices 504-508 in a cloud. However, in other examples, the processing device 706 and NMD 704 may be a same device or the audio playback device 702 and processing device 706 may be a same device. In yet other examples, the audio playback device 702 and NMD 704 may a same device and separate from the processing device 706. In other examples, the processing device 706 may be distributed such that associated are performed by multiple devices depending on available processing resources of the multiple devices. Other variations are also possible.

Figure 8A:
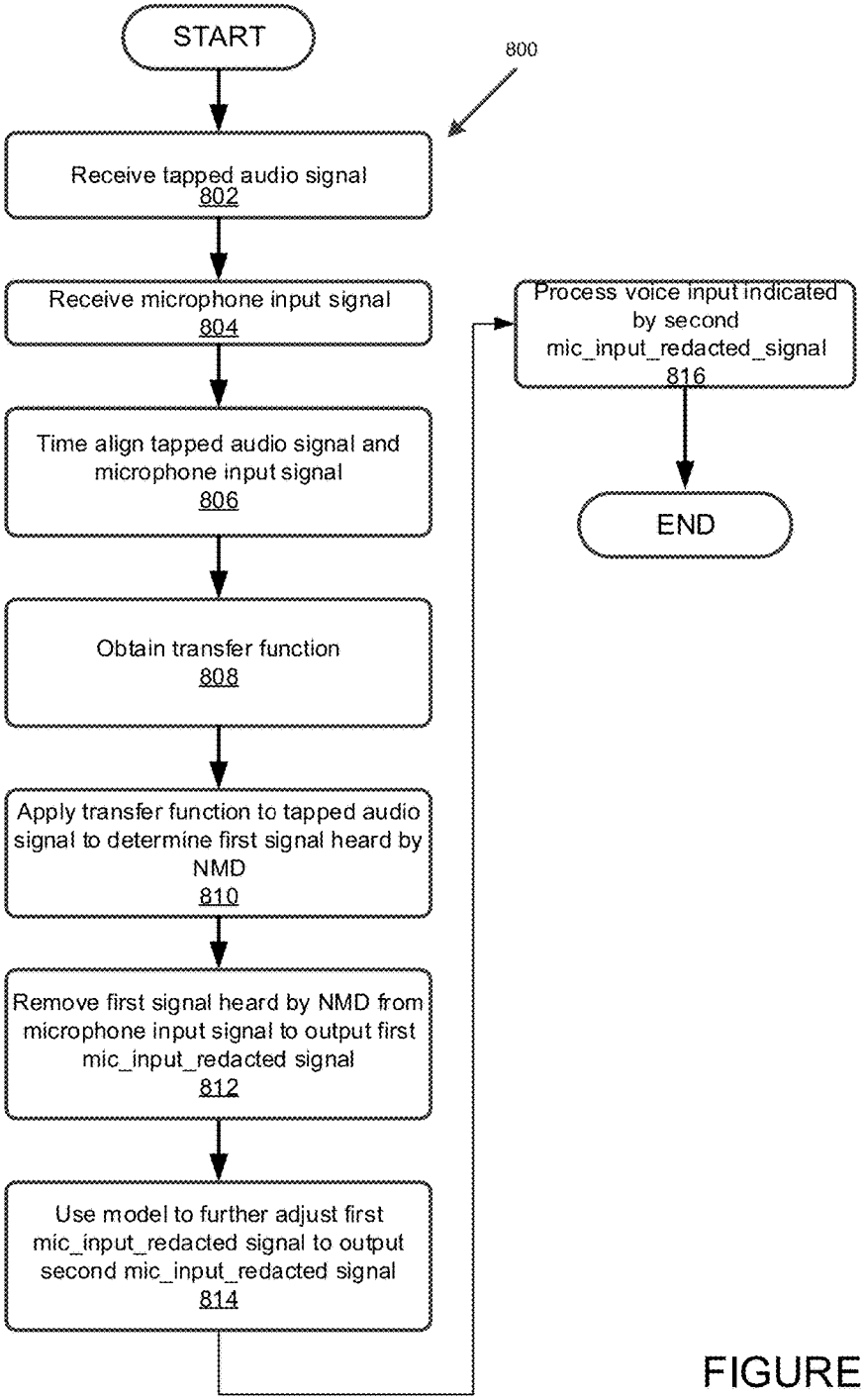
FIG. 8A is a flow chart of functions associated with self-sound suppression.

FIG. 8A is a flow chart 800 of functions associated with self-sound suppression. In one example, the functions of the flow chart 800 may be performed by one or more of the audio playback device. In a second example, the functions of the flow chart 800 may be performed by one or more of the NMD. In a third example, the functions of the flow chart 800 may be performed by one or more of the processing device 706. In a fourth example, the functions of the flow chart 800 may be performed by a combination of one or more of the audio playback device, NMD, and/or processing device. Other arrangements are also possible.

For the implementation and other processes and methods disclosed herein, the arrangement shows functionality and operation of one possible implementation of some embodiments. In this regard, each block may represent a module, a segment, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as tangible, non-transitory computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the implementation and other processes and methods disclosed herein, each block in FIG. 8A may represent circuitry that is wired to perform the specific logical functions in the process.

Referring to FIG. 8A, at 802, a tapped audio signal may be received. For example, the processing device may have a network interface for receiving the tapped audio signal from the audio playback device. At 804 a microphone input signal 1304 may be received. For example, the processing device may have a network interface for receiving the microphone input signal from the NMD. The tapped audio signal and microphone input signal may be a digital signal or an analog signal. If one or both of the tapped audio signal at the audio playback device and the microphone input signal at the NMD are analog signals, then the respective analog signal may be sent to the processing device and the processing device may convert the respective analog signal to a respective digital signal. Alternatively, the audio playback device may convert the tapped audio signal to a respective digital signal via an analog to digital converter and then send the respective digital signal to the processing device. Similarly, the NMD may convert the microphone input signal to a respective digital signal via an analog to digital converter and then send the respective digital signal to the processing device.

An acoustic delay may be an acoustic transmission time associated with travel of the audio played by the playback device from a speaker of the audio playback device, through the air, and to the microphone of the NMD. At 806, the microphone input and the tapped audio signal may be timed aligned to account for this acoustic delay. In some instances, the time alignment may also account for processing delay by one or more of the audio playback device and NMD.

Figure 8B:
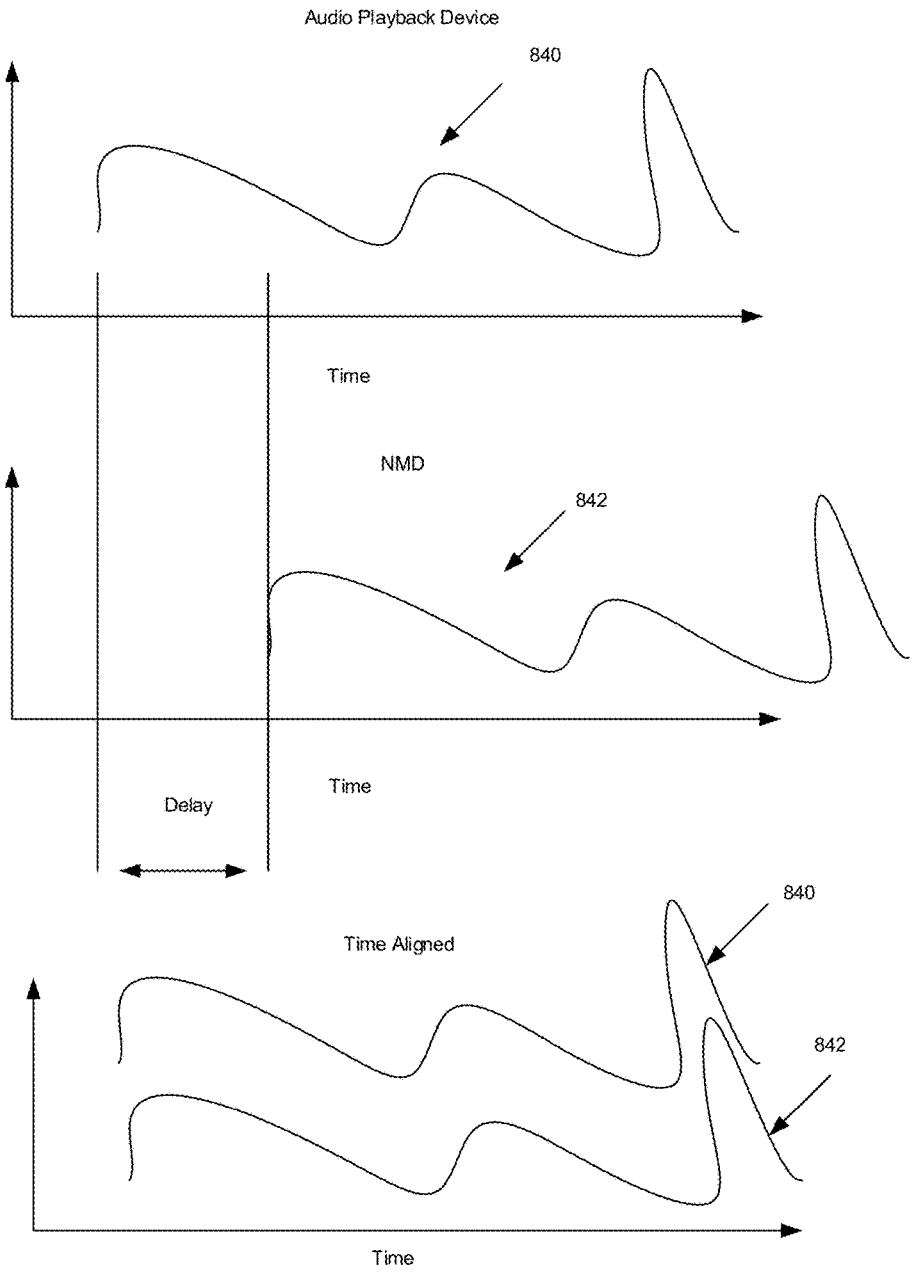
FIG. 8B illustrates an example time alignment of signals.

FIG. 8B illustrates an example time alignment of signals. Two portions of a signal are shown. Tapped audio signal 840 may be a portion of the tapped audio signal to be played back by the audio playback device. Microphone input signal 842 may be a portion of the microphone input signal received by the NMD at a later time after the audio playback device plays the tapped audio signal 840. The delay between the respective portions may be the acoustic delay. The portion of the tapped audio signal 840 and the portion of the microphone input signal 842 may be time aligned to account for this acoustic delay.

In one example, the time alignment may be performed by determining the acoustic delay between the devices and then using the acoustic delay to perform the time alignment. The acoustic delay may be determined by first establishing synchronization between the audio playback device, NMD, and/or processing device. For example, clocks associated with the audio playback device, NMD, and/or processing device may be synchronized or a known offset or drift between the clocks determined. A clock timestamp may indicate a time of the clock on the playback device when a portion of a given audio signal is tapped in the audio signal pathway (which may be different from the tapped audio signal received at 802). This clock timestamp may be sent to the processing device. Similarly, the MID may determine a clock timestamp associated with when that same given portion of the audio signal is received by the NMD at its microphone (which may be different from the microphone input signal received at 804). This clock timestamp may also be sent to the processing device. The difference in clock timestamps, accounting for any of the known drift and/or offset, may be indicative of the acoustic delay. Then, knowing the acoustic delay, the microphone input signal received at 802 and the tapped audio signal received at 804 can be time aligned.

The portion of audio that is used in determining the acoustic delay may take a variety of forms. For example, the portion may be first audio samples played back by the audio playback device when audio playback is initiated by the audio playback device, e.g., at a beginning of an audio track. A clock timestamp may be associated with these first samples. When the NMD receives these first samples at its microphone, the NMD may assign a clock timestamp associated with the receipt of the first samples at its microphone. Then, the processing device may calculate a difference between the clock timestamps indicative of the acoustic delay which is used to time-align the microphone input signal with the tapped audio signal. The delay may be rechecked at regular intervals. Further, the clock timestamps assigned by the audio playback device can be analyzed over time to determine presence of and/or correct for network jitter or clock drift.

In another example, the portion of audio that is used to deter mine the acoustic delay may be fingerprinted. Fingerprinting in an audio context relates to identifying songs, melodies, tunes, etc. from a portion of audio. Fingerprinting may involve sending a given portion of the audio to be played back by the audio playback device (e.g., the tapped audio signal) to a system can identify a track of audio associated with the given portion in view of any background noise. Similarly, fingerprinting may involve sending a given a portion of the audio received by the microphone to the system which can identify a track of audio associated with the given portion in view of any background noise.

Upon verifying that the portion of audio received by the NMD is in the same track as the portion of audio played by the audio playback device, e.g., both is "Track 1" of "Album 1" by "Prince", the NMD may assign a clock timestamp, e.g., 2050. The clock timestamp may indicate when the NMD received the portion of audio. The fingerprinting may also identify a position where the portion of audio received by the NMD is in the track, e.g., "1 minutes and 10 seconds from a beginning of track 1." The audio playback device may assign clock time stamps as it plays each portion of audio defined by the track. These clock time stamps may be further associated with the position in the track. For example, the audio playback device may have a table that indicates that the portion of audio at "1 minute and 10 seconds from a beginning of track 1" was played at clock timestamp 2000. Based on the clock timestamp 2000 from the audio playback device and the clock stamp 2050 from the NMD, the processing device may determine the acoustic delay as 50 clock cycles. The acoustic delay may be used to time align the portions of the microphone input signal received at 802 and the tapped audio signal received at 804.

In yet another example, time alignment may be performed by finding a best fit between the portions of the microphone input signal received at 802 and the tapped audio signal received at 804. The microphone input signal and the tapped audio signal may be overlapped and one signal shifted with respect to another until differences between the two signals are minimized, e.g., a correlation is maximum. The differences may be determined in a time domain or a frequency domain. The shift of the microphone input signal with respect to the tapped audio signal when the difference is minimized is indicative of the acoustic delay.

In another example, the acoustic delay between the microphone input signal 802 and the tapped audio signal 804 may be known and the NMD may use this known delay to perform the time alignment. The acoustic delay may be established via a calibration process where the audio playback device may playback a given signal, at a known time, and the NMD may receive the given signal at the microphone input at a later time. The given signal may be a tone such as a sine wave. Based on knowing the time that the audio playback device played the given signal and the later time when the NMD received the given signal, the acoustic delay may be calculated as a difference between the respective times and used for the time alignment.

In yet another example, the known delay may be determined by mixing a known signal with content played by the audio playback device at a known time. For example, the known signal may be a sine tone which may be outside a hearing range of a listener, such as 22 kHz. In the case of the audio playback device having multiple playback devices, a frequency of the sine tone may be uniquely associated with a particular playback device, e.g., a first playback device may mix a sine tone at a first frequency and a second playback device may mix a sine tone at a second frequency. A clock timestamp may be associated with when the sine tone is mixed with the content. When the NMD receives the sine tone mixed with the content played, the NMD may assign a clock timestamp associated with the receipt of the sine tone. Then, a difference may be calculated between the timestamps to calculate the acoustic delay. The acoustic delay may be used to time-align the microphone input signal with the tapped audio signal. The NMD may also determine a frequency of the tone via a filtering process to correlate the acoustic delay to a particular audio playback device.

In another example, the acoustic delay may be based on a physical relationship between the NMD and the audio playback device. Specifically, a physical distance between a speaker and a microphone may define the acoustic delay. In the case that the NMD and audio playback device are a same device, the acoustic delay may be how long it takes for the audio played by the speaker to travel to the microphone. This time can be calculated based on the physical distances between the speaker and microphone and the speed of sound.

Referring back to FIG. 8A, at 808, a transfer function may be obtained. The transfer function may be stored in memory and/or received from another network device. Unlike conventional transfer functions used in self-sound suppression, the transfer function may comprise a relative frequency response between a given tapped audio signal and a given microphone input signal which are time aligned. The transfer function may be calculated as:

FFT of the Given Microphone Input Signal/FFT of the Given Tapped Audio Signal

The transfer function can be determined as part of an initialization or update process. In this regard, the given microphone input signal and the given tapped audio signal used to determine the transfer function may be typically different from the received tapped audio signal 802 and received microphone input signal 804. Moreover, the transfer function may be static or adaptive.

The transfer function may be static when the microphone and speaker are in a static location. An example of this may be when the NMD and audio playback device are the same device, and the position of the microphone and speaker are each physically fixed. Alternatively, the transfer function may be static as a result of being calculated once, e.g., during a calibration process, and not being updated. On the other hand, the transfer function may be adaptive if at intervals of time, a new transfer function is determined. This new transfer function may replace an earlier determined transfer function or the new transfer function may be averaged with one or more transfer functions determined earlier in time.

For example, the transfer function may be updated when the audio playback device starts playing audio. As another example, the transfer function may be updated when background noise is low, e.g., no voice input is being spoken to the NMD. The determination of whether the background noise is low can be determined in a variety of ways. For example, the background noise may be low if an amplitude the audio received at a certain frequency is below a threshold amount. As another example, the background noise may be low if no voice input is being received. No voice input may be received if an amplitude of the audio received in a certain direction where a user is known to be located (via beamforming) is below a threshold amount. In this case, the new transfer function can be determined. Beamforming is a signal processing technique used in sensor arrays for directional signal transmission or reception.

As yet another example, the transfer function may be updated when the audio playback device or the NMD detects motion. The audio playback device and/or the NMD may have a sensor for detecting motion, such as an accelerometer or gyroscope. If the NMD or audio playback device detects motion above a threshold amount, then a new transfer function may be determined. As another example, the transfer function may be determined after power is restored to the audio playback device or the NMD after being lost. Power may be restored after being lost when the device is unplugged, moved, and plugged in again. This event may be indicative of the audio playback device or NMD being moved such that acoustic coupling between the devices is altered and therefore the representative the transfer function needs updating.

At 810, the transfer function may be applied to the tapped audio signal to output a first indication of the signal as heard at the NMD, e.g., mic_input_redacted signal. For example, the transfer function may be multiplied with the tapped audio signal in a frequency domain. Then, at 812, the first indication of the signal may be removed from the microphone input signal, resulting in a redacted microphone input signal which attempts to isolate the voice input:

Mic_input_redacted=Mic_input−(Tapped audio signal*transfer function)

The redaction may be further modified to account for nonlinear audio effects resulting from the nonlinear response of the audio playback device. The processing device may store and/or receive from a computing device 504-508, NMD, and/or audio playback device, a model of the nonlinear audio effects output by the audio playback device. An example of such a non-linear audio effect may be distortion, specifically ID.

The model may output a time dependent frequency response, a mathematical representation of the nonlinear audio effects of the audio playback device, or some other indication of the audio playback device's nonlinear response which is used to alter a signal, e.g., tapped audio signal, representative of the audio being played back by the audio playback device. For example, the output may take the form of a time varying indication of a magnitude, phase, and/or frequency output by the audio playback device based on a history of audio signals input to the audio playback device. Further, the output may be in a time domain or frequency domain.

In one example, the model may be based on difference equations. Difference equations are equations that recursively define a sequence or multidimensional array of values: once one or more initial terms are given, each further term of the sequence or array is defined as a function of the preceding terms. Various measurements may be performed with respect to the audio playback device to determine this model. In one example, an audio signal may be input into the audio playback device and a BL factor (e.g., product of magnetic field strength in the voice coil gap and the length, thickness, dielectric constant, magnetic permeability, etc. of the wire in the magnetic field) indicative of a motor strength of the transducer may be measured as a function of position of a transducer. The position may be that of the voice coil or some other structure of the transducer. In another example, a spider of the transducer may be considered a spring and the air a damper, and a spring constant of the cone as a function of position may be determined. In yet another example, an inductance of the transducer as a function of position may be determined. Using these determinations and the difference equations, which may continue to change as BL, force, current, voltage, temperature, inductance etc. of the transducer change, the model may be defined which outputs a time dependent frequency response indicative of nonlinear audio effects of the transducer.

The position as a function of the described inputs may be measured in a variety of ways. In one example, the position may be calculated from measurable quantities such as current and voltage and a physical model that describes operation of the transducer. The physical model may model aspects of the transducer through an equivalent electrical, mechanical, and acoustical circuit. This equivalent circuit allows insight into what parameters change characteristics of transducer. However, calculating the position in this manner requires significant processing power and adds latency. Predictive based determination of position may also be used but these methods are inaccurate because they do not account for mechanical and thermal variances which may affect a transducer's performance. In another example, the position may be physically measured with a laser measurement device.

In some examples, a sensor may be embedded in a moving component of a speaker. For example, the sensor may be a compact force sensor such as a micro-electro-mechanical device such as a MEMS accelerometer. The sensor may measure acceleration of the moving component of the transducer which is in turn used to determine a position of the moving component.

FIGS. 9A-D show various exemplary positions where a sensor can be placed, e.g., affixed, on and/or embedded in the transducer. The sensor may be affixed and/or embedded with an adhesive such as glue or epoxy or fastener such as a screw or clip.

Figure 9A:
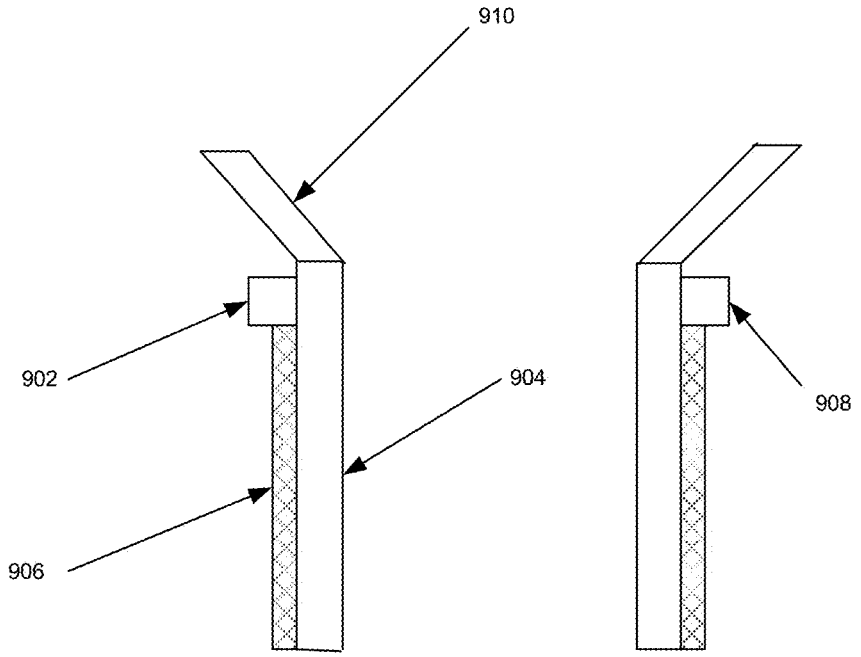
FIG. 9A-D shows various positions where a sensor can be placed on a transducer.

In FIG. 9A, a sensor 902 may be embedded in a voice coil former 904 adjacent to a wire coil 906 of the transducer. A voice coil may include the voice coil former 904 around which the wire coil 906 is wound. The sensor 902 may detect movement of the voice coil. Two sensors 902, 908 may be embedded to maintain symmetry in the speaker or a counterweight may be added to counter addition of one sensor, e.g., one sensor and one counterweight may be added. The counterweight may be a plastic or metal object with a weight similar to that of the sensor 902. Further, the sensors may be placed substantially near a cone 910 to minimize any elastic response of the voice coil former 904.

Figure 9B:
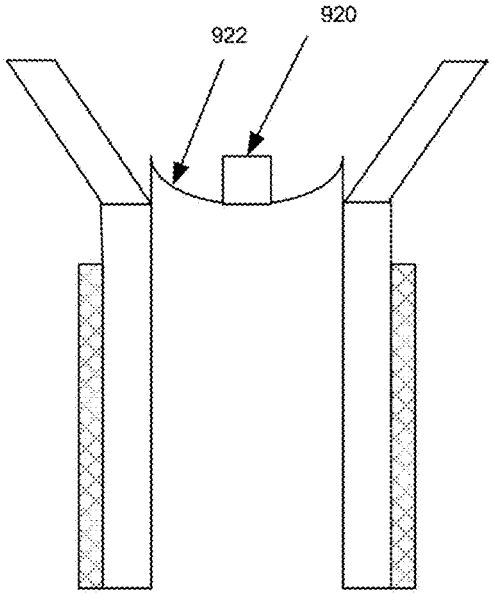

In FIG. 9B, the sensor 920 may be placed at a center of a dust cap 922 which typically protects inner mechanics of the transducer such as the voice coil. The placement on the dust cap 922 avoids the symmetry concern. But the placement may affect flexing of the dust cap and result in a low pass filtering. However, if the nonlinear audio effects of interest are also at low frequency (e.g., voice input is around 50 to 500 Hz), then the placement would not impact the time dependent frequency response output by the model at the low frequency.

Figure 9C:
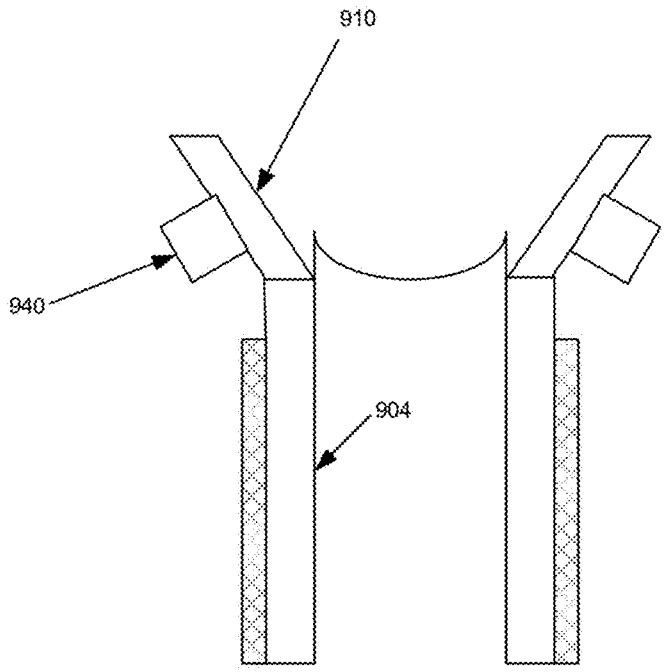

In FIG. 9C, the sensor 940 may be placed on a cone 910 of the transducer. The cone 910 may be a thin, semi-rigid membrane attached to the voice coil, which moves in a magnetic gap, vibrating the cone 910, and producing sound. In some examples, the sensor may be placed close to the voice coil former 904 to mitigate any low pass effect which would increase with placement further away radially from the voice coil former 904.

Figure 9D:
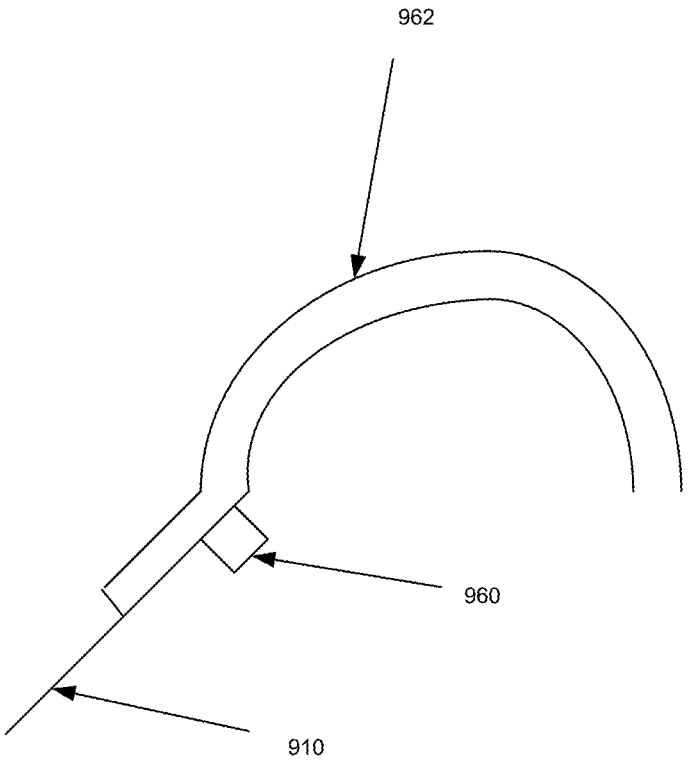

In FIG. 9D, the sensor 960 may be embedded to an inner portion of a surround 962 of the transducer. The surround 962 is usually made of foam or rubber which is attached to the cone 910 of the transducer. The surround 962 may flex allowing the cone 910 to move when the transducer operates. The sensor 960 on the surround 962 may or may not require a counterweight. Other variations are also possible.

The sensor may have a flexible connection from a static portion of the transducer to the sensor on the moving part of the transducer. The flexible connection may take the form of tinsel leads or be embedded into the surround 962 or cone 910.

An electrical output of the sensor may be sampled at a sampling rate. The sampling rate may be based on the Nyquist theorem. In this regard, the sampling rate may be at least double the highest frequency of interest, e.g., range of frequencies for which a frequency response of the transducer is desired. For example, if the frequency of interest is from 0 to 8 KHz, then the electrical output of the force sensor may be sampled at 16 KHz.

Position of the moving component may be determined from a simplified version of the damped harmonic oscillator model:

$$F = F_{ext} - kx - c\frac{dx}{dt} = m\frac{d^2x}{dt^2}.$$

where F_ext is an external force, k is a spring constant, and c is a damping constant.

Because there is no external force, F_ext, in a transducer and the measured force already accounts for c and k, this model simplifies to:

$$x(t)=\iint Fm(t)dt\ dt \text{ where } t \text{ is an integration period}$$

The integration period may be based on a sampling rate of the sensor. The sampling period may be calculated as (force sensor sampling rate/44100)*packet size, which is a minimum sample period in terms of packet size over which the integration is performed. In this example calculation, the packet size may be 128 samples and the Nyquist sampling rate for audio may be 44100 Hz. As a result, if the sensor sampling rate is 44100 Hz, then the integration period may be 1 packet or 128 samples. Alternatively, if the sensor sampling rate is 22050 Hz, then the integration period may be over two packet sizes which is 64 samples. In this regard, the integration period may be over a number of samples output by the sensor that matches a time length of a packet.

X(t)_actual may represent an exact positioning of a moving component of the transducer on which the sensor is placed. In turn, placement of the sensor at a different location on the transducer may result in a different positioning due to different physical distortions at that location. This position may be used to define the model of nonlinear audio effects output by the audio playback device and/or used by the model to determine the time-dependent frequency response.

In some situations, the sensor may have drift. For instance, the sensor may not measure x(t)_actual=0 when it is known the moving component of the transducer is stationary, e.g., no audio input signal is being input to the transducer. A drift offset that indicates this discrepancy may be incorporated into the calculation of the x(t)_actual.

Further, the voice coil may have a known force curve that indicates the force applied at different currents and/or voltages. The force curve may be symmetrical due to the physical arrangement of the transducer. As a result, any asymmetry that is measured by the sensor (where acceleration is proportional to force) may be attributed to drift. The difference between the measured asymmetry and the symmetrical force curve may be the drift which is applied in determining x(t)_actual.

In another example, the model may be based on a Volterra series or Weiner-Hammerstein Model which may account for a history of operation of the transducer. Coefficients associated with the Volerra series and Weiner-Hammerstein Model may be set based on physical characteristics and performance characteristics of the transducer. An example of the physical characteristics may include the spring constant of the cone, mechanical variances, and imperfections in the transducer and an example of the performance characteristic may include voltage, current, and temperature in a voice coil. These models may output a time dependent frequency response representative of the non-linear audio effects of the transducer.

In yet another example, a model that describes operational characteristics of the transducer may be used to determine nonlinear audio effects of the transducer. A representation of the tapped audio signal input may be input into the model and nonlinear audio effects of the transducer calculated as current, voltage, resistance, inductance, temperature etc. associated with the transducer change.

In another example, a model of nonlinear audio effects may be defined based on the output of the sensor and the microphone input signal. For example, a model may be defined relating the output of the sensor to the microphone input signal. Unlike the models described above, this model may account for any nonlinearities in a response of the microphone because the microphone input signal is formed after being received by a membrane of the microphone which may have a non-linear response. The model may also output the nonlinear audio effects associated with the transducer and microphone.

Referring back to FIG. 8A, at 814, the model may be used to further adjust mic_input_redacted to account for nonlinear audio effects of the audio playback device. A representation of the tapped audio signal may be input into the model and the model may provide an output. If the model outputs a time dependent frequency response in the form of an FFT in response to the input, the FFT output by the model may be time aligned with a FFT of the tapped audio signal and multiplied to yield a "compensated audio output signal" (e.g., tapped audio signal with nonlinear audio effects associated with the transducer). If the model outputs a time domain signal in response to the input, then each sample output by the model may be summed with a time aligned corresponding sample of the tapped audio signal to yield the compensated audio output signal. In some cases, an amplitude of the output of the model as a time domain signal may be normalized with an amplitude of the tapped audio signal, or vice versa, prior to being summed.

The transfer function may then be applied to the compensated audio output signal to improve the redaction, e.g., isolation of voice input. For example, in the frequency domain this redaction may be calculated as:

Mic_input_redacted=Mic_input−(compensated audio output signal*transfer function)

Equivalently, the redaction may be represented as:

Mic_input_redacted=Mic_input−(tapped audio signal*transfer function)−(output of model*transfer function)

where the transfer function is altered by the output of the model. Similar equations may exist for performing redaction in a time domain. In some examples, the non-linear model may alter the transfer function at 808 of FIG. 8.

A signal indicative of the voice input may remain after the microphone input is compensated for nonlinear audio effects. At 816, the signal, e.g., voice input, may be interpreted by the NMD or passed to a voice processing device for processing. In one example, the processing may include detecting a trigger word, e.g., "Hey Sonos", indicative of a command to follow such as "Play Track 1." On another example, the processing may include converting the speech to text. In yet another example, the processing may include interpreting intent of a speaker based on the voice input when the voice input itself does not definitively identify a command or action. In another example, the processing may include determining emotions based on the voice input. In yet another example, the processing may include determining one or more of a location of speaker, identity, gender, age, etc. U.S. patent application Ser. No. 15/223,218 entitled "Voice Control of a Media Playback Device" filed Jul. 29, 2016, the contents of which are herein incorporated by reference in its entirety provides further examples of such voice input processing. The processing may take other forms as well.

In some embodiments, the output of the model may be used to precompensate the tapped audio signal.

Figure 10:
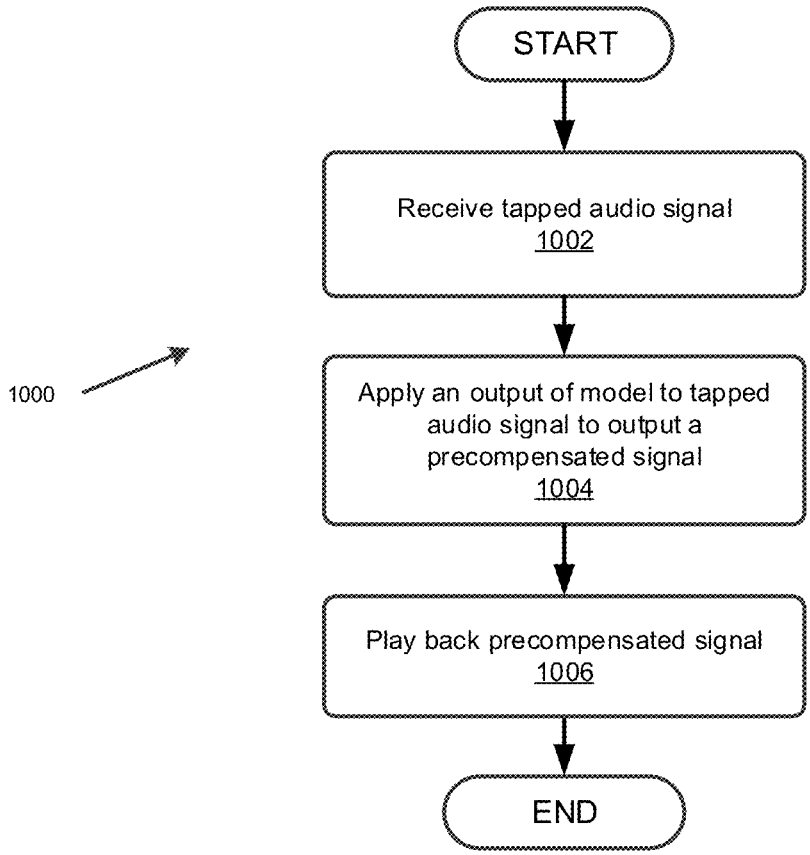
FIG. 10 is a flow chart of functions associated with precompensation.

FIG. 10 is a flow chart of functions associated with precompensation 1000. At 1002, a tapped audio signal may be received. At 1004, an output of the model may be applied to the tapped audio signal. For instance, the output of the model may be subtracted from the tapped audio signal to produce a precompensated signal. At 1006, the precompensated signal may be played back by the audio playback device. The precompensation results in any nonlinearities introduced by the speaker being substantially cancelled out by the precompensation.

In turn, because the audio played by the playback device may not have substantial nonlinear audio effects and the microphone input signal may not receive substantial nonlinear audio effects from the audio, the processing device need not to account for the nonlinear audio effects in the self-sound suppression. For example, application of the equation: Mic_input_redacted=Mic_input−(Tapped audio signal*transfer function) may be sufficient to isolate the voice input. Further, by precompensating the tapped audio, quality of sound reproduction may be improved since the nonlinear audio effects are not present in the audio output by the playback device.

Further, in some instances, the output of the sensor may be used to determine a measure of distortion output by the audio playback device. The audio signal, e.g., tapped audio signal, is indicative of a force, e.g., applied as an electrical signal to the transducer. As a result, the measure of distortion of the playback device may be calculated as:

distortion=tapped audio signal−sensor signal where a sample of an amplitude of the tapped audio signal is subtracted from a corresponding output of the sensor when the speaker outputs audio associated with that sample.

In another example, the measure of distortion may be determined based on the measure of position using the sensor. The x(t)_actual may be compared to an x(t)_modeled. The x(t) modeled may be determined based on applying a physical model of the transducer to the tapped audio signal. A difference may be calculated between x(t)_modeled and x(t)_actual. This difference is indicative the measure of distortion due to the non-linear response of the transducer. This measure of distortion may include inaccuracies in the physical model. The inaccuracies may include thermal variances and mechanical variances. The thermal variances may be changes in temperature of the transducer during operation. The mechanical variances may be due to operating conditions such as change in stiffness of a component of the transducer with temperature, manufacturing tolerances, and manufacturing imperfections.

In yet another example, the measure of distortion may be determined based on comparing x(t)_actual to the tapped audio signal. Other variations also exist for determining the measure of distortion.

The comparison may be used to determine whether the measure of distortion is acceptable. For example, the measure of distortion after applying precompensation may be compared to a threshold to determine if the measure of distortion is acceptable. Additionally, or alternatively, the measure of distortion as a result of applying the model of nonlinear audio effects in self-sound suppression may be monitored in order to decide whether to tune the model. For example, the measure of distortion may be compared to a threshold to determine if the measure of distortion is acceptable. If the difference exceeds a threshold amount, then the model may be tuned for improvement by updating one or more parameters of the model such as that associated with the difference equations, Volterra Series, or Weiner Hammerstein Model to reduce distortion. The tuned model may output a better representation of the nonlinear audio effects associated with the audio playback device. Further, the model can use the measure of distortion to calculate an expected measure of distortion which can be used to precompensate the tapped audio signal.

X(t)_actual may define nonlinear audio effects associated with the transducer such as ID. In some embodiments, the transfer function may be applied to x(t)_actual to output a first resulting signal. The transfer function may also be applied to the tapped audio signal to output a second resulting signal. Then, this first and second resulting signal may be subtracted from the microphone input signal to determine the mic_input_redacted signal, e.g., isolated voice input.

In some embodiments, the position information associated with the sensor, e.g., x(t)_actual, may be used to more accurately determine position of a moving component of the transducer. As a result, the moving components of a transducer can be driven to an operational limit without risking damage to the component. The operational limit may be a maximum excursion or distance that the moving component may travel before being damaged. So long as the position of the moving component as indicated by the position information is less than a threshold, the moving component can be driven closer to its operational limit. This may allow for maximum performance of the transducer.

In some embodiments, multiple audio playback devices may be in proximity to an NMD in an audio playback environment.

Figure 11:
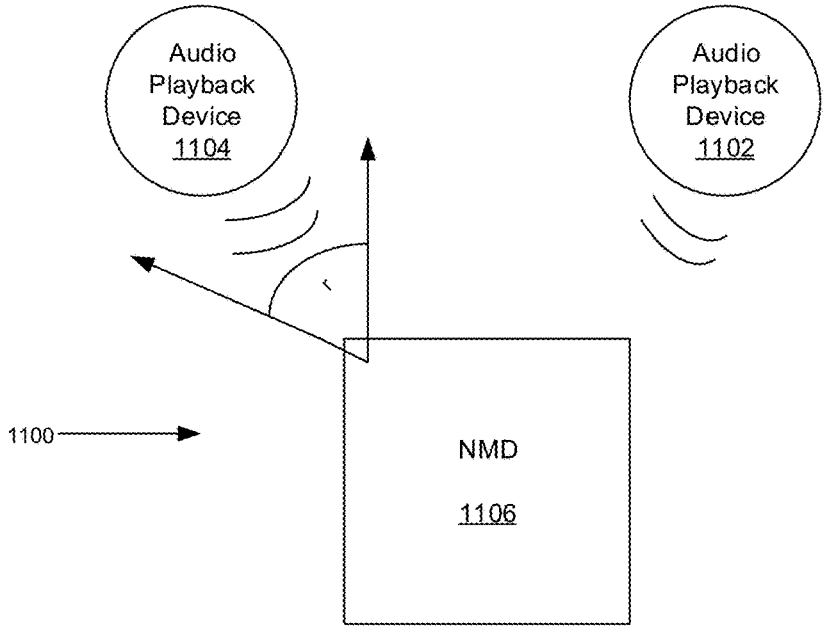
FIG. 11 shows a top view of an audio playback environment with multiple audio playback devices.

FIG. 11 shows top view of an example audio playback environment 1100 which has one or more audio playback devices and one or more NMDs. In the audio playback environment, there may be two audio playback devices: audio playback device 1102 and audio playback device 1104, and NMD 1106.

Each audio playback device may not be playing a same audio content. Instead, each audio playback device may be playing a channel of audio, e.g., left channel played by audio playback device 1102, right channel played by audio playback device 1104. Alternatively, an audio playback device may be playing a portion of one or more channels of audio. For instance, the audio playback device 1102 may be playing 50% of the left channel and 20% of the right channel and the audio playback device 1104 may be playing 30% of the right channel. Each audio playback device may send to a processing device (not shown) the tapped audio signal for a channel/portion of a channel of audio being played.

Additionally, the NMD may send a microphone input signal associated with the audio played by the audio playback device to the processing device. In some examples, the microphone input signal may be beamformed to contain a response of the audio playback device to the exclusion of other audio playback devices also playing back audio. For example, the NMD 1106 may receive audio at one or more microphones within an angular range of r degrees so that only the audio played back by audio playback device 1104 is received.

In some examples, the NMD may have determined a separate transfer function for each channel or portion of one or more channels of audio. In other examples, the NMD may determine a transfer function for multiple channels or multiple playback devices, e.g., when the NMD is located "on axis."

Figure 12:
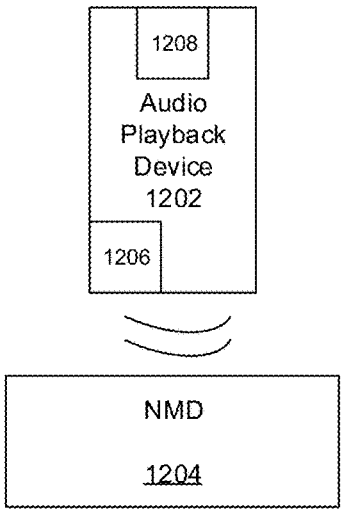
FIG. 12 shows a side view of an NMD located on axis with respect to an audio playback device.

FIG. 12 shows a side view of an NMD 1204 located on axis e.g., above or below, an audio playback device 1202. The audio playback device 1202 may have two transducers 1206 and 1208 where the two transducers may be playing different channels, e.g., left channel and right channel. In this example, the transfer function determined by the NMD 1204 may be associated with both transducers 1206, 1208 because the NMD cannot beamform to an individual transducer in the axial direction.

The NMD 1204 may provide the transfer function associated with the audio playback device which output the audio to the processing device. The processing device may perform suppression for each audio playback device, each channel, each portion of the channel, and/or each axis.

In some embodiments, the transducers of an audio playback device may be positioned such that a distance to an NMD may be different for the two transducers.

FIG. 12 further illustrates the differing distances of such transducers. A first transducer 1206 may be located on axis below a second transducer 1208 in the audio playback device 12002 and the NMD 1204 may be located on axis below the first transducer 1206 and second transducer 1208. In this regard, the NMD 1204 may be closer to the first transducer 1206 than the second transducer 1208. As a result, the audio played by the first transducer 1206 and second transducer 1208 may be received at different times by the NMD 1204. The difference in location of the two transducers may affect a frequency range over which a model can determine the nonlinear audio effects for the combination of transducers. For examples, instead of being able to determine the nonlinear audio effects in a 0 to 22 KHz range for an audio signal sampled at a Nyquist rate of 44 KHz, the nonlinear audio effects may be determined in a 0 to 2.2 kHz range if there is a 10 sample delay introduced because of the difference in distances between the two transducers, e.g., a maximum delay due to fixed distances (This assumes the inter-transducer delay is not compensated for relative to a listening 'direction' of the NMD. If compensated for, there is a sinusoidal relationship between listening direction and peak phase distortion, where the peak phase distortion=eff_distance_between_transducers/speed_of_sound. As such, the actual phase distortion extends from −1*peak_phase_distortion to +1*peak_phase_distortion (as the NMD moves around the playback device from one side to the other, where the actual phase distortion follows a sine curve in-between these two location extremes)). Such a reduced frequency range may be acceptable, however, if the frequency range of the voice input also falls within this frequency range. This may be the only frequency of interest where nonlinear audio effects are to be suppressed.

The self-sound suppression may be performed in yet other audio playback environments including bonded zones, zone groups, environments with multiple NMDs etc.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

What is claimed is:

1. An audio system comprising:

a playback device comprising a speaker, the playback device disposed at a first location; and a network microphone device disposed at a second location, the network microphone device being displaceable relative to the playback device, the network microphone device comprising:

a microphone;

a processor; and memory storing instructions executable by the processor to cause the processor to:

receive a first signal indicative of audio to be played back via the speaker of the playback device and a second signal that comprises (i) a voice input received via the microphone and (ii) at least a portion of the audio played by the speaker of the playback device at a same time that the microphone receives the voice input; and perform self-sound suppression on at least one of the first signal and the second signal, wherein performing self-sound suppression comprises:

based on the first signal, determining nonlinearities output via the speaker of the playback device by inputting a representation of the first signal into a model configured to output an indication of a frequency response that changes over time, wherein at least a portion of the frequency response is indicative of nonlinear audio effects, and wherein the nonlinear audio effects comprise an intermodulation distortion; and removing at least a portion of the determined nonlinearities from the second signal to output a third signal comprising substantially the voice input received at the microphone.

2. The audio system of claim 1, wherein the model is based on measurement of a position of a moving component of the speaker.

3. The audio system of claim 1, wherein removing at least the nonlinearities from the second signal to output a third signal comprises determining a compensated audio signal based on the first signal and the nonlinear audio effects output by the speaker of the playback device, wherein the compensated audio signal characterizes how the audio played by the speaker sounds at the microphone.

4. The audio system of claim 1, wherein removing at least the nonlinearities from the second signal to output a third signal comprises applying a transfer function to the first audio signal wherein the transfer function is a relative frequency response between a fourth signal indicative of second audio to be played by the speaker of the playback device and a fifth audio signal received at the microphone when the second audio is played.

5. The audio system of claim 1, wherein the microphone is located within a given distance from speaker of the playback device, wherein at the given distance the microphone detects the audio played by the speaker of the playback device.

6. The audio system of claim 1, further comprising computer instructions for converting the voice input in the third signal into text.

7. The audio system of claim 1, wherein the first signal is tapped from a signal processing pathway associated with the speaker of the playback device after a time varying filter is applied to the first signal.

8. A method comprising:

receiving a first signal indicative of audio to be played back via a speaker of a playback device disposed at a first location and a second signal that comprises (i) a voice input received via a microphone of a network microphone device disposed at a second location, the network microphone device being displaceable relative to the playback device, and (ii) at least a portion of the audio played by the speaker at a same time that the microphone receives the voice input; and performing self-sound suppression on at least one of the first signal and the second signal, wherein performing self-sound suppression comprises:

based on the first signal, determining nonlinearities output via the speaker of the playback device by inputting a representation of the first signal into a model configured to output an indication of a frequency response that changes over time, wherein at least a portion of the frequency response is indicative of nonlinear audio effects, and wherein the nonlinear audio effects comprise an intermodulation distortion; and removing at least a portion of the determined nonlinearities from the second signal to output a third signal comprising substantially the voice input received at the microphone of the network microphone device.

9. The method of claim 8, wherein the model is based on measurement of a position of a moving component of the speaker.

10. The method of claim 8, wherein removing at least the nonlinearities from the second signal to output a third signal comprises determining a compensated audio signal based on the first signal and the nonlinear audio effects output by the speaker, wherein the compensated audio signal characterizes how the audio played by the speaker sounds at the microphone.

11. The method of claim 8, wherein removing at least the nonlinearities from the second signal to output a third signal comprises applying a transfer function to the first audio signal wherein the transfer function is a relative frequency response between a fourth signal indicative of second audio to be played by the speaker and a fifth audio signal received at the microphone when the second audio is played.

12. The method of claim 8, wherein the microphone is acoustically proximate to the speaker.

13. The method of claim 8, further comprising converting the voice input in the third signal into text.

14. The method of claim 8, wherein the first signal is tapped from a signal processing pathway associated with the speaker after a time varying filter is applied to the first signal.

15. A tangible non-transitory computer readable storage medium including instructions for execution by a processor, the instructions, when executed, cause the processor to implement a method comprising:

receiving a first signal indicative of audio to be played back via a speaker of a playback device disposed at a first location and a second signal that comprises (i) a voice input received via a microphone of a network microphone device disposed at a second location, the network microphone device being displaceable relative to the playback device, and (ii) at least a portion of the audio played by the speaker at a same time that the microphone receives the voice input; and performing self-sound suppression on at least one of the first signal and the second signal, wherein performing self-sound suppression comprises:

based on the first signal, determining nonlinearities output via the speaker of the playback device by inputting a representation of the first signal into a model configured to output an indication of a frequency response that changes over time, wherein at least a portion of the frequency response is indicative of nonlinear audio effects, and wherein the nonlinear audio effects comprise an intermodulation distortion; and removing at least a portion of the determined nonlinearities from the second signal to output a third signal comprising substantially the voice input received at the microphone of the network microphone device.

16. The tangible non-transitory computer readable storage medium of claim 15, further comprising computer instructions to obtain acoustics of an environment in which the speaker is located; and apply the acoustics to the third signal comprising substantially the voice input received at the microphone.

* * * * *